US007942217B2

(12) United States Patent
Salins et al.

(10) Patent No.: US 7,942,217 B2
(45) Date of Patent: May 17, 2011

(54) CUTTING APPARATUS FOR A MICROTUNNELLING SYSTEM

(75) Inventors: Andis Salins, Footseray (AU); Stuart Harrison, Dandenong South (AU)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 12/335,232

(22) Filed: Dec. 15, 2008

(65) Prior Publication Data

US 2009/0152012 A1 Jun. 18, 2009

Related U.S. Application Data

(63) Continuation of application No. PCT/AU2006/001122, filed on Aug. 8, 2006.

(30) Foreign Application Priority Data

Jun. 16, 2006 (AU) ..... 2006903269

(51) Int. Cl.
*E21B 10/28* (2006.01)
*E21B 10/00* (2006.01)

(52) U.S. Cl. ..... 175/334; 175/347; 175/354; 175/367; 175/368

(58) Field of Classification Search ..... 175/42, 175/62, 215, 334, 339, 347, 349, 354, 367, 175/368, 386, 413; 299/1.4, 1.8, 55, 58, 299/81.1

See application file for complete search history.

(56) References Cited

U.S. PATENT DOCUMENTS 134,506 A * 1/1873 Ball ..... 175/326
825,857 A * 7/1906 Moran et al. ..... 299/56
858,525 A * 7/1907 Mettler ..... 15/104.13

(Continued)

FOREIGN PATENT DOCUMENTS

AU B-80723/87 4/1988

(Continued)

OTHER PUBLICATIONS

International Preliminary Report on Patentability (PCT/AU2006/001122).

(Continued)

*Primary Examiner* — Shane Bomar
*Assistant Examiner* — Cathleen R Hutchins
(74) *Attorney, Agent, or Firm* — Merchant & Gould P.C.

(57) ABSTRACT

The present disclosure relates to a microtunnelling apparatus including a cutting apparatus adapted to be rotated by a drill shaft defining a central axis of rotation that extends along a length of the drill shaft. The cutting apparatus includes a front cutting rotor having a hub defining a shaft receiver that extends at least partially through the hub in a direction extending from a back side toward a front cutting side of the front cutting rotor. The shaft receiver is configured to receive the drill shaft. The drill shaft and the shaft receiver cooperate to define a torque transmitting mechanical interface for allowing torque to be transferred between the drill shaft and the front cutting rotor such that the drill shaft can be used to rotate the front cutting rotor about the central axis of rotation. The front cutting rotor also includes a plurality of cutting bars that project at least partially radially outwardly from the hub. The cutting apparatus further includes a front retainer that mounts at the front cutting side of the front cutting rotor for retaining the front cutting rotor on the drill shaft.

23 Claims, 21 Drawing Sheets

Section C-C

U.S. PATENT DOCUMENTS

| | | | | |
|---|---|---|---|---|
| 1,026,412 | A | 5/1912 | Stone | |
| 1,772,491 | A * | 8/1930 | Koppl | 175/343 |
| 2,317,729 | A | 4/1943 | Bruno | |
| 2,494,803 | A | 1/1950 | Frost et al. | |
| 2,745,650 | A * | 5/1956 | Smith | 299/80.1 |
| 2,786,652 | A | 3/1957 | Wells | |
| 2,850,264 | A | 9/1958 | Grable | |
| 3,145,789 | A * | 8/1964 | Lawry | 175/386 |
| 3,208,539 | A | 9/1965 | Henderson | |
| 3,297,100 | A | 1/1967 | Crews | |
| 3,321,248 | A | 5/1967 | Williamson et al. | |
| 3,354,950 | A | 11/1967 | Hyde | |
| 3,419,092 | A | 12/1968 | Elenburg | |
| 3,459,442 | A | 8/1969 | Yarmett et al. | |
| 3,482,103 | A | 12/1969 | Martinsen | |
| 3,498,673 | A | 3/1970 | Ledray et al. | |
| 3,508,622 | A | 4/1970 | Benetti et al. | |
| 3,554,301 | A | 1/1971 | Adkins et al. | |
| 3,635,108 | A | 1/1972 | Prince | |
| 3,707,330 | A | 12/1972 | Pine | |
| 3,778,107 | A | 12/1973 | Haspert | |
| 3,799,615 | A | 3/1974 | Taylor et al. | |
| 3,821,993 | A | 7/1974 | Kniff et al. | |
| 3,837,413 | A * | 9/1974 | Dunn | 175/292 |
| 3,857,449 | A | 12/1974 | Kimura | |
| 3,938,597 | A | 2/1976 | Richmond et al. | |
| 3,939,926 | A | 2/1976 | Barnes et al. | |
| 4,013,134 | A | 3/1977 | Richmond et al. | |
| 4,023,861 | A | 5/1977 | Schnell | |
| 4,026,371 | A | 5/1977 | Takada et al. | |
| 4,027,210 | A | 5/1977 | Weber | |
| 4,059,163 | A | 11/1977 | Stedman | |
| 4,076,084 | A | 2/1978 | Tighe | |
| 4,099,585 | A | 7/1978 | Emmerich | |
| 4,122,683 | A | 10/1978 | Follert et al. | |
| 4,149,739 | A | 4/1979 | Morris | |
| 4,186,808 | A | 2/1980 | Cox | |
| 4,221,503 | A | 9/1980 | Cherrington | |
| 4,273,468 | A | 6/1981 | Cyfka | |
| 4,311,344 | A | 1/1982 | Akesaka | |
| 4,378,057 | A | 3/1983 | O'Connell | |
| 4,392,744 | A | 7/1983 | Tatsuhama et al. | |
| 4,394,881 | A | 7/1983 | Shirley | |
| 4,403,664 | A | 9/1983 | Sullinger | |
| 4,406,498 | A | 9/1983 | Akesaka | |
| 4,494,617 | A | 1/1985 | Snyder | |
| 4,506,745 | A | 3/1985 | Bjor | |
| 4,553,612 | A | 11/1985 | Durham | |
| 4,556,256 | A | 12/1985 | Follert et al. | |
| 4,576,515 | A | 3/1986 | Morimoto et al. | |
| 4,624,605 | A | 11/1986 | Akesaka | |
| 4,630,869 | A | 12/1986 | Akesaka et al. | |
| 4,655,493 | A | 4/1987 | Sumi | |
| 4,683,944 | A | 8/1987 | Curlett | |
| 4,692,062 | A | 9/1987 | Akesaka | |
| 4,698,491 | A | 10/1987 | Lysen | |
| 4,784,230 | A | 11/1988 | Cherrington et al. | |
| 4,790,395 | A | 12/1988 | Gack et al. | |
| 4,828,050 | A | 5/1989 | Hashimoto | |
| 4,834,193 | A | 5/1989 | Leitko, Jr. et al. | |
| 4,836,305 | A | 6/1989 | Curlett | |
| 4,868,648 | A | 9/1989 | Nobunaga | |
| 4,875,292 | A | 10/1989 | Gibson | |
| 4,886,394 | A | 12/1989 | Akesaka | |
| 4,961,469 | A | 10/1990 | Larsson et al. | |
| 5,046,903 | A | 9/1991 | Nagayoshi et al. | |
| 5,076,729 | A | 12/1991 | Grotenhofer | |
| 5,078,545 | A | 1/1992 | Akesaka | |
| 5,099,927 | A | 3/1992 | Gibson et al. | |
| 5,102,201 | A | 4/1992 | Akesaka | |
| 5,123,708 | A | 6/1992 | Akesaka | |
| 5,133,418 | A | 7/1992 | Gibson et al. | |
| 5,156,490 | A | 10/1992 | Terasawa | |
| 5,163,520 | A | 11/1992 | Gibson et al. | |
| 5,236,284 | A | 8/1993 | Ilomaki | |
| 5,265,682 | A | 11/1993 | Russell et al. | |
| 5,296,915 | A | 3/1994 | Akesaka | |
| 5,316,092 | A | 5/1994 | Ilomäki | |
| 5,361,854 | A | 11/1994 | Tull et al. | |
| 5,366,031 | A | 11/1994 | Rickards | |
| 5,393,172 | A | 2/1995 | Akesaka | |
| 5,423,575 | A | 6/1995 | Parks | |
| 5,425,429 | A | 6/1995 | Thompson | |
| 5,437,500 | A | 8/1995 | Lehmann et al. | |
| 5,465,797 | A | 11/1995 | Wentworth et al. | |
| 5,470,132 | A | 11/1995 | Cartwright | |
| 5,484,232 | A | 1/1996 | Hayashi et al. | |
| 5,485,889 | A | 1/1996 | Gray | |
| 5,501,548 | A | 3/1996 | Hayashi et al. | |
| 5,527,135 | A | 6/1996 | Hayashi et al. | |
| 5,529,437 | A | 6/1996 | Filipowski et al. | |
| 5,632,575 | A | 5/1997 | Lorenzen et al. | |
| 5,682,953 | A | 11/1997 | Buysse | |
| 5,682,956 | A | 11/1997 | Deken et al. | |
| 5,687,807 | A | 11/1997 | Woods et al. | |
| 5,846,027 | A | 12/1998 | Fujii | |
| 5,860,232 | A | 1/1999 | Nathenson et al. | |
| 5,887,667 | A | 3/1999 | Van Zante et al. | |
| 5,890,771 | A | 4/1999 | Cass | |
| 5,931,240 | A | 8/1999 | Cox | |
| 5,938,288 | A | 8/1999 | Saint-Pierre et al. | |
| 6,017,095 | A | 1/2000 | DiMillo | |
| 6,050,350 | A | 4/2000 | Morris et al. | |
| 6,148,935 | A | 11/2000 | Wentworth et al. | |
| 6,158,529 | A | 12/2000 | Dorel | |
| 6,332,652 | B1 | 12/2001 | Nakakuro | |
| 6,342,946 | B1 | 1/2002 | Holstein | |
| 6,390,087 | B1 | 5/2002 | Wentworth et al. | |
| 6,454,025 | B1 | 9/2002 | Runquist et al. | |
| 6,470,605 | B1 | 10/2002 | Gilman et al. | |
| 6,527,054 | B1 | 3/2003 | Fincher et al. | |
| 6,533,052 | B2 | 3/2003 | Wentworth et al. | |
| 6,585,062 | B2 | 7/2003 | Rozendaal et al. | |
| 6,588,515 | B2 | 7/2003 | Wentworth et al. | |
| 6,659,202 | B2 | 12/2003 | Runquist et al. | |
| 6,668,946 | B2 | 12/2003 | Rankin et al. | |
| RE38,418 | E | 2/2004 | Deken et al. | |
| 7,055,627 | B2 | 6/2006 | Fontana et al. | |
| 7,070,359 | B2 | 7/2006 | Richardson et al. | |
| 7,093,671 | B2 | 8/2006 | Puttmann | |
| 7,111,695 | B2 | 9/2006 | Puttmann | |
| 7,152,702 | B1 * | 12/2006 | Bhome et al. | 175/384 |
| 7,216,724 | B2 | 5/2007 | Self et al. | |
| 7,243,737 | B2 | 7/2007 | Michael | |
| 7,367,412 | B2 | 5/2008 | Barbera et al. | |
| 7,389,831 | B2 | 6/2008 | Mullins et al. | |
| 2004/0060740 | A1 | 4/2004 | Puttmann | |
| 2004/0074672 | A1 * | 4/2004 | Rives | 175/57 |
| 2004/0108139 | A1 | 6/2004 | Davies | |
| 2005/0257959 | A1 | 11/2005 | Richardson et al. | |
| 2006/0060384 | A1 | 3/2006 | Michael | |
| 2007/0143773 | A1 | 6/2007 | Park et al. | |

FOREIGN PATENT DOCUMENTS

| | | |
|---|---|---|
| AU | 12360/88 | 9/1988 |
| DE | 32 03 924 A 1 | 8/1983 |
| DE | 40 18 842 C 1 | 7/1991 |
| DE | 101 32 972 C 1 | 10/2002 |
| EP | 1 316 670 B1 | 6/2003 |
| JP | 53-126713 | 11/1978 |
| JP | 61-40988 | 2/1986 |
| JP | 63-190394 | 12/1988 |
| JP | 02-016287 | 1/1990 |
| JP | 03-033393 | 2/1991 |
| JP | 03-047396 | 2/1991 |
| JP | 04-353189 | 12/1992 |
| JP | 05-202688 | 8/1993 |
| JP | 6-40094 | 5/1994 |
| JP | 07-293191 | 11/1995 |
| JP | 2000-328876 | 11/2000 |
| JP | 2005213848 A | 8/2005 |
| SU | 1579976 A1 | 7/1990 |
| WO | WO 88/02435 | 4/1988 |
| WO | WO 94/20726 | 9/1994 |
| WO | WO 02/44508 A2 | 6/2002 |
| WO | WO 02/44511 A1 | 6/2002 |
| WO | WO 02/064939 A1 | 8/2002 |

| | | | |
|---|---|---|---|
| WO | WO 2006/119797 | A1 | 11/2006 |
| WO | WO 2007/124789 | A1 | 11/2007 |
| WO | WO 2007/143773 | A1 | 12/2007 |

OTHER PUBLICATIONS

Written Opinion of the International Searching Authority (PCT/AU2006/001122).

Klein et al. "New Developments in Microtunneling." Paper presented at 36$^{th}$ Engineering Geology and Geotechnical Engineering Symposium, University of Nevada, Las Vegas. Mar. 28-30, 2001.

Nagashima et al. "'Trunk Mole': Long Distance Micro-Tunneling Method for Gas Transmission Pipelines." 1995 International Gas Research Conference, Pipeline Engineering and Development Center, Tokyo Gas Co., Ltd.

USPTO Office Action, dated Sep. 11, 2009, issued for U.S. Appl. No. 12/335,232, in the name of Salins et al.

"EPB Machine Part No. A10500F" Product information sheet. Akkerman Inc. www.akkerman.com.

"Thrust Frame—Latching—308A" Product information sheet. Akkerman Inc. www.akkerman.com.

"Thrust Frame—4812A" Product information sheet. Akkerman Inc. www.akkerman.com.

"Upsizing Tool—Powered Cutter Head" Product information sheet. Akkerman Inc. www.akkerman.com.

"Earth Pressure Balance Machines (EPBM)" Product information. Akkerman Inc. Downloaded Jun. 2, 2009, (http://www.akkerman.com/products-epb.php).

"Microtunneling" Product information. Akkerman Inc. Downloaded Jun. 2, 2009. (http://www.akkerman.com/products-microtunneling/php).

"Guided Boring Machines (GBM)" Product Information. Akkerman Inc. Downloaded Jun. 2, 2009. (http://www.akkerman.com/products-gbm.php).

"Conventional Tunneling Boring Machine (TBM)" Product information. Akkerman Inc. Downloaded Jun. 2, 2009. (http://www.akkerman.com/products-conventional-tbm.php).

"Guided Boring Machine" Technical Manual. Akkerman Inc. Downloaded Jun. 2, 2009. (http://www.akkerman.com/products-products-manuals.php).

Vermeer HDD Tooling & Accessories Catalog, vol. 6, 2005.

* cited by examiner

COVER REMOVED FOR CLARITY

CUTTING APPARATUS FOR A MICROTUNNELLING SYSTEM

This application is a Continuation of PCT/AU2006/001122, filed 8 Aug. 2006, which claims benefit of Serial No. 2006903269, filed 16 Jun. 2006 in Australia and which applications are incorporated herein by reference. To the extent appropriate, a claim of priority is made to each of the above disclosed applications.

FIELD OF THE INVENTION

This invention relates to underground boring and more particularly to an improved microtunnelling system and apparatus.

In this document "microtunnelling" is considered to comprise trenchless horizontal boring of a bore of the order of 600 millimeters and less.

BACKGROUND OF THE INVENTION

Modern installation techniques provide for underground installation of services required for community infrastructure. Sewage, water, electricity, gas and telecommunication services are increasingly being placed underground for improved safety and to create more visually pleasing surroundings that are not cluttered with open services.

Currently, the most utilised method for underground works is to excavate an open cut trench. This is where a trench is cut from the top surface and after insertion of piping or optical cable is then back-filled. This method is reasonably practical in areas of new construction where the lack of buildings, roads and infrastructure does not provide an obstacle to this method. However, in areas supporting existing construction, an open cut trench provides obvious disadvantages, major disruptions to roadways and high possibility of destruction of existing infrastructure (i.e. previously buried utilities). Also, when an open cut trench is completed and backfilled the resultant shift in the ground structure rarely results in a satisfactory end result as the trench site often sinks. Open trenches are also unsafe to pedestrians and workers.

Another concept employed for underground works is that of boring a horizontal underground hole. Several methods employ this philosophy as it generally overcomes the issues of disruption to roads and infrastructure as described for open cut trenches however even these methods have their inherent problems.

One method is horizontal directional drilling (HDD). In this method a boring device is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the surface. A reamer is then attached to the drill string, which is pulled back through the borehole, thus reaming out the borehole to a larger diameter. It is common to attach a utility line or other conduit to the reaming tool so that it is dragged through the borehole along with the reamer. A major problem with this method is that the steering mechanism is extremely inaccurate and unsuitable for applications on grade. The stop and start action utilised by the operator results in a bore that is not completely straight. The operator has no way of knowing exactly where the hole goes which can result in damage to existing utilities. This could pose a safety threat particularly if the services in the area are of a volatile nature.

Another method is the pilot displacement method. This method uses a drill string pushed into the ground and rotated by a jacking frame. A theodolite is focused along the drill string as a point of reference to keep the line on grade. This system is not accurately steered. The slant on the nose is pointed in the direction of intended steering. The position of the head is monitored through a total station with a grade and line set and measuring this point against a target mounted in the head of the pilot string. If the ground conditions are homogenous and the conditions absolutely perfect, it will produce a satisfactory bore. Unfortunately this is rarely the case. Ground conditions are generally variable the pilot tube will tend to steer towards whichever ground offers the least resistance irrespective of the direction in which you are the steering. As the drill strings are generally short, the time to drill is often slow with repeated connections making the process tedious. Once the bore reaches the reception shaft augers are attached and pulled back along the bore to displace the spoil into the reception shaft. This then has to be manually removed which is time consuming.

Slurry style microtunnelling utilises slurry reticulation to transport spoil removal throughout the installation process. Two lines are fed via a starting shaft along the bore. The pipes are jacked via a hydraulic jacking frame into the hole. Water is forced along the feed pipe to the cutting face where the spoil slurry of rock and mud is forced back along the return pipe. Whilst enjoying a good degree of accuracy, this system requires a structural shaft that needs a massive amount of force to push the pipes. This results in a large, expensive jacking shaft pit that is time consuming to build. The sheer weight and size of the components make them slow to connect and cumbersome to use, If the unit becomes damaged or stuck in the bore, the only method available to retrieve the unit would be to dig down onto the drill head location.

In one form of boring machine shown by U.S. Patent Application No. U.S. 2004/0108139 to Davies and corresponding to Australian Patent 2003262292 there is disclosed a micro tunnelling machine having a tunnelling head with a boring bit which is forced in a horizontal direction by an hydraulic thruster. The direction of the head is laser guided. The beam strikes a target in the head and a camera relays an image of the target to an operator located at the tunnel entrance. The operator adjusts the direction by admitting water and draining water from a pair of rams inside the head, which move the boring bit up and down or left and right. A semi automatic version is disclosed in which a microprocessor adjusts the direction until the operator assumes control. In particular the invention is claimed to be a guidance system for the boring head of a micro-tunnelling machine of the type which bores in a selected direction and inclination using laser beam guidance having the endmost part of the drive to the boring bit adjustable in two directions at 90°, wherein, the endmost part of the drive has a target for the laser beam, means to convey an image of the target and the laser strike position thereon to an operator situated remotely from the boring head and input means for the operator to adjust the direction of the endmost part of the drive.

The major approach of the directional control of the disclosed apparatus of U.S. Patent Application No. U.S. 2004/0108139 to Davies is to have the drive shaft connected at its end distal to the cutting edge in a manner that allows the drive shaft to move as required and to allow the cutting element to be redirected to correct position as determined by the laser controlled directional system. However this form of apparatus places all the strain on an elongated movable drive shaft retained by cylinders and therefore readily increases the risk of breakage. There is clearly a need to provide an improved system to decrease chance of breakage of the drill head components.

It can be appreciated that present methods of underground tunnelling are cumbersome, inaccurate; and require repeated halting of boring operations due to waste removal and heating effects. Moreover, there is an inherent delay resulting from replacement of parts of conventional boring systems since it usually requires the boring tool to be recovered from the site and returned to the assembly factory. Recovery in itself can be cumbersome and expensive particularly if a new vertical access hole is required to recover the tool. This could damage the road or services under which the bored tunnel is extending. Further present systems are unable to accurately remain on fixed boring direction, which are often needed when a buried obstruction is detected or changing soil conditions are encountered.

SUMMARY OF THE INVENTION

In accordance with the invention there is provided an apparatus and method for underground boring on grade more particularly to an improved microtunnelling system and apparatus.

In this document "microtunnelling" is considered to comprise trenchless horizontal boring of a bore of the order of 600 millimeters and less. This is particularly relevant to the insurgence of pipes of the order of around 300 millimeters.

The drawbacks of current microtunnelling technology are significant and have been overcome or are at least ameliorated by the current invention including one or more of the following improvements and other improvements as will be understood from the description.

A first fundamental improvement is the use of an external casing with flow channels therein and the drive rod mounted therein and allows for all cabling and hosing to be mounted in an external cavity, which thereby allows for continuous cabling over a plurality of encased intermediate drill rods.

A second fundamental improvement is the incorporation of the driveline within the vacuum chamber. Incorporating the rotation within the vacuum achieves multiple goals. Firstly, the vacuum area can be dramatically increased and so maximize the machines ability to remove spoil and in such increased productivity. Secondly, the rotation component of the drill rod generates heat. The removal of this heat from the laser area is critical to laser accuracy. By combining the rotation into the vacuum area, any heat generated is immediately removed and the laser therefore is unaffected.

A third fundamental improvement is the steering mechanism of the encased drill rod using radially protrusions engaging steering shell to direct the drill head and prevent any undue force on the drill head centrally mounted within the casing.

A fourth fundamental improvement is the modular structure of the drill head by a plurality of disc like modules that can be created by direct external etching, drilling or casting or the like and be combined in cylindrical shells to form a readily assembled drill head.

A fifth fundamental improvement is the modular components of the drive means that allows for differing rotational units to be used with a thrust unit that provides linear pull as well as push capabilities. This allows matching of rotational units to material being bored and size of pipe being inserted and further allows for reverse reaming to a larger diameter after initial bore has been accurately drilled.

BRIEF DESCRIPTION OF THE DRAWINGS

In order that the invention is more readily understood an embodiment will be described by way of illustration only with reference to the drawings wherein.

DETAILED DESCRIPTION OF THE INVENTION

Figure 1:
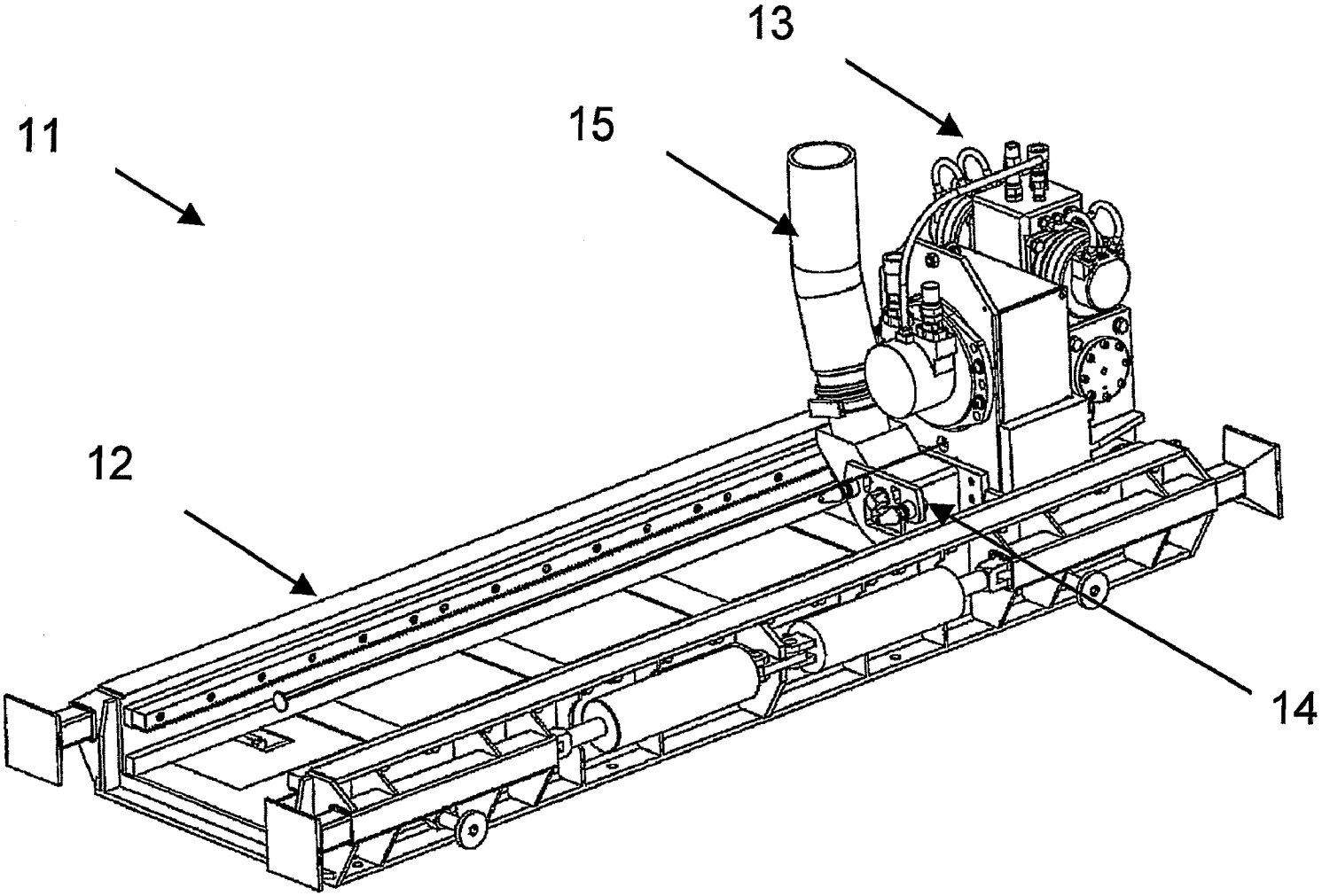
FIG. 1 is a perspective view of a drive means of a microtunnelling system and apparatus in accordance with the invention including a thrust module and rotation module mounted on a rack system and further including a vacuum for assisting return slurry.

Referring to the drawings there is shown a microtunnelling apparatus and system that comprises a drive system (11), a drill head section (20) and intermediate drill rods (41) allowing extension of the boring hole created by the drill head section driven by the drive system.

The drive system (11) as shown in FIG. 1 includes a power source and a track system for allowing limited linear drive of the power source. The track system includes a rack and pinion gearing system (12) to allow maintained linear thrust pressure along the length of the track. The power source includes a hydraulic thrust module (13), which reciprocates a rotation module (14) housed in the thrust box in the launch shaft. The product pipe can be either pushed or pulled into place for pipeline completion.

Figure 14:
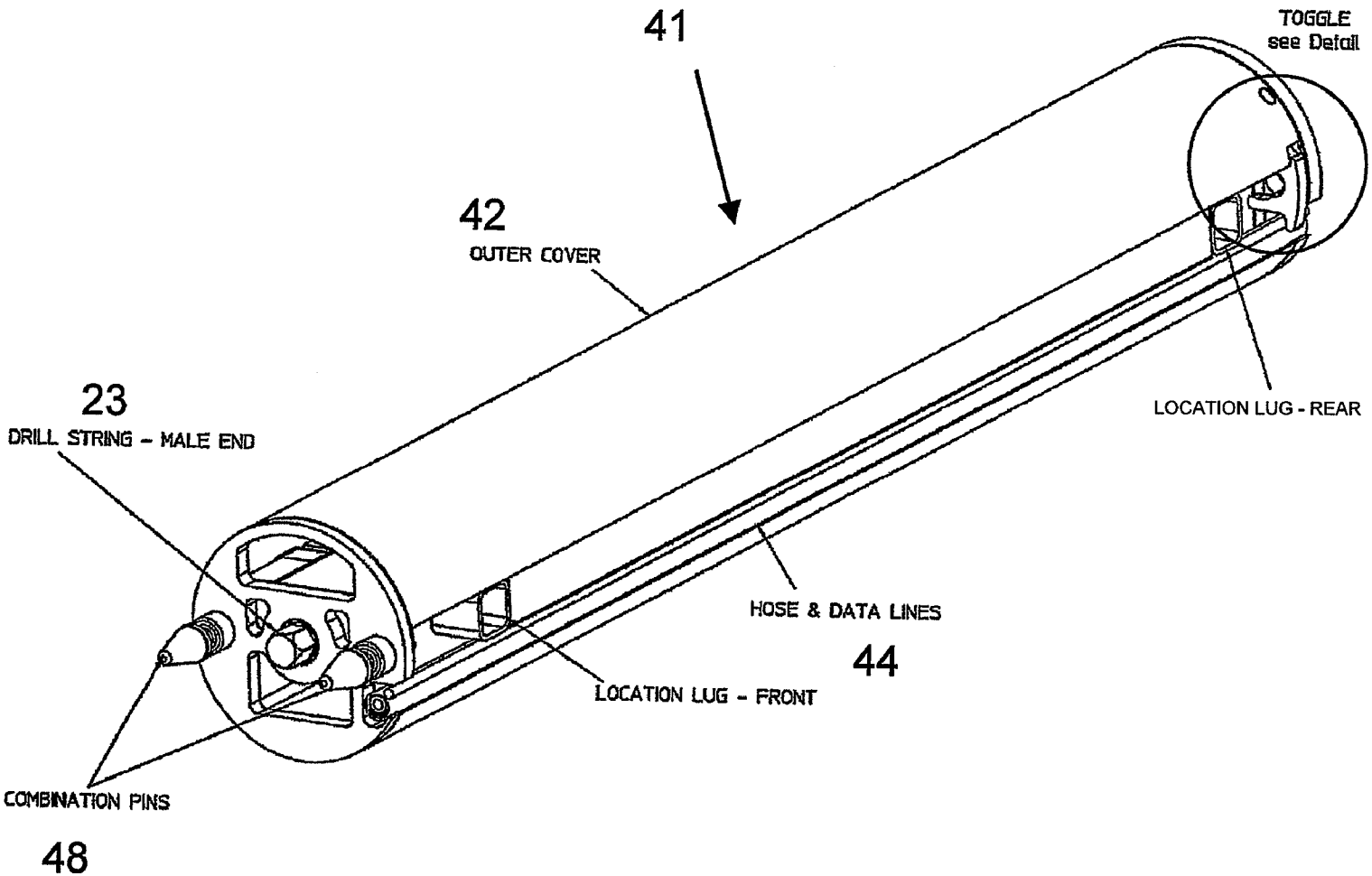
FIG. 14 is a perspective view of a drive rod for extending between the drive means of FIG. 1 and the drill head of FIG. 2
Figure 15:
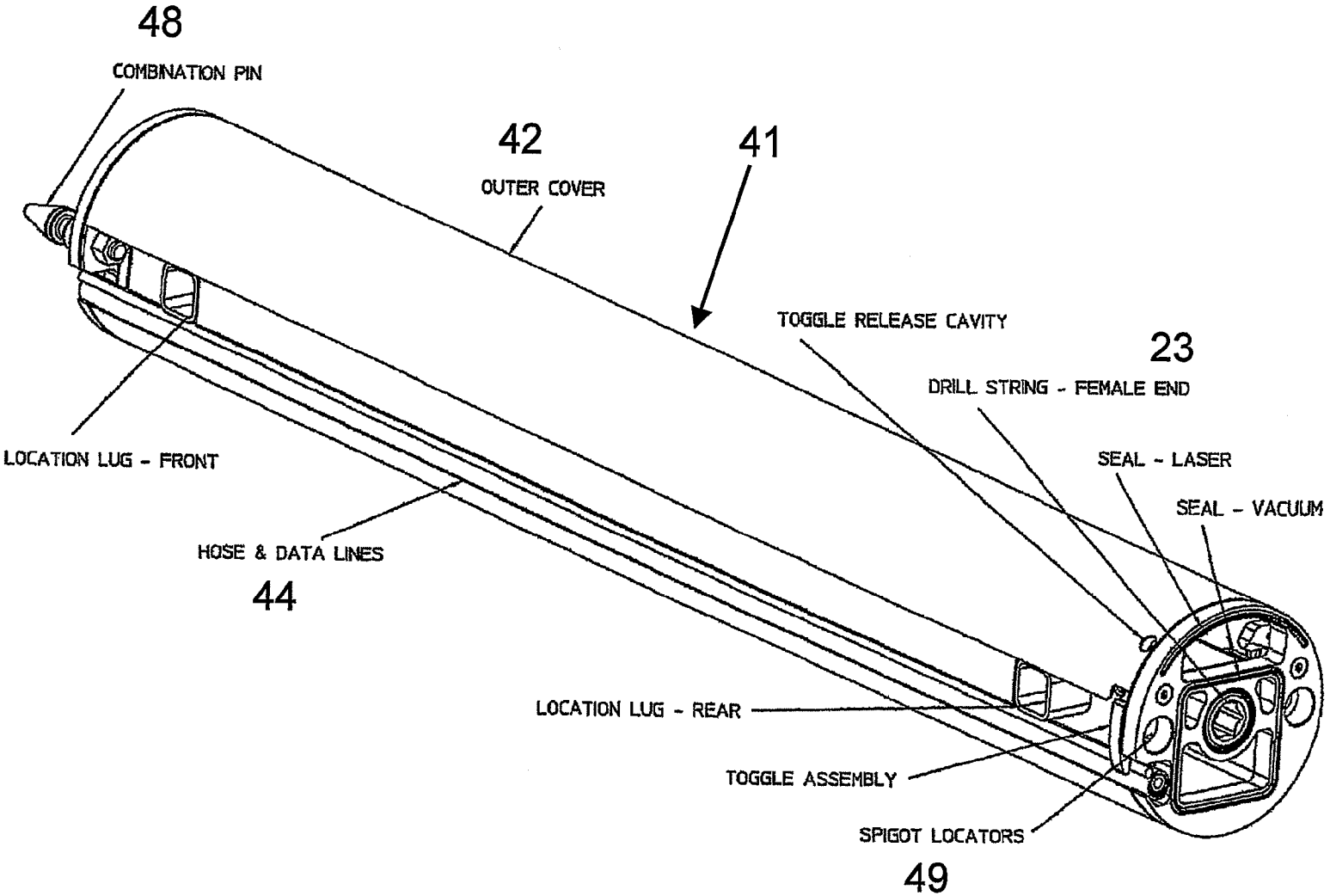
FIG. 15 is a perspective reverse view of the drive rod of FIG. 6.

To the front of the rotation module (14) is attached encased intermediate drill rods (41) such as shown in FIGS. 14 and 15.

Figure 2:
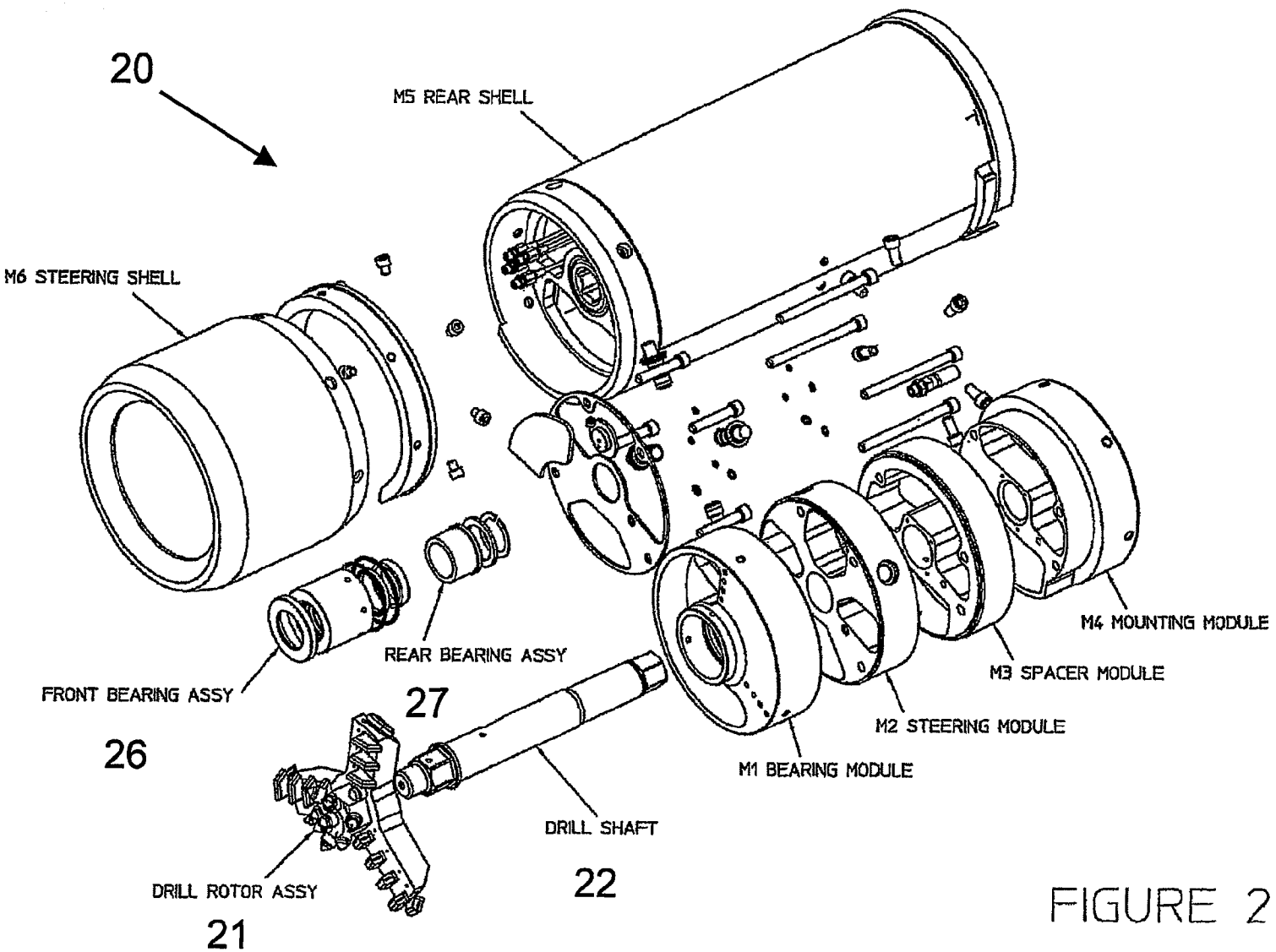
FIG. 2 is a perspective exploded view of a drill head able to be driven by the drive means of FIG. 1 for use in the microtunnelling system and apparatus in accordance with the invention.
Figure 4:
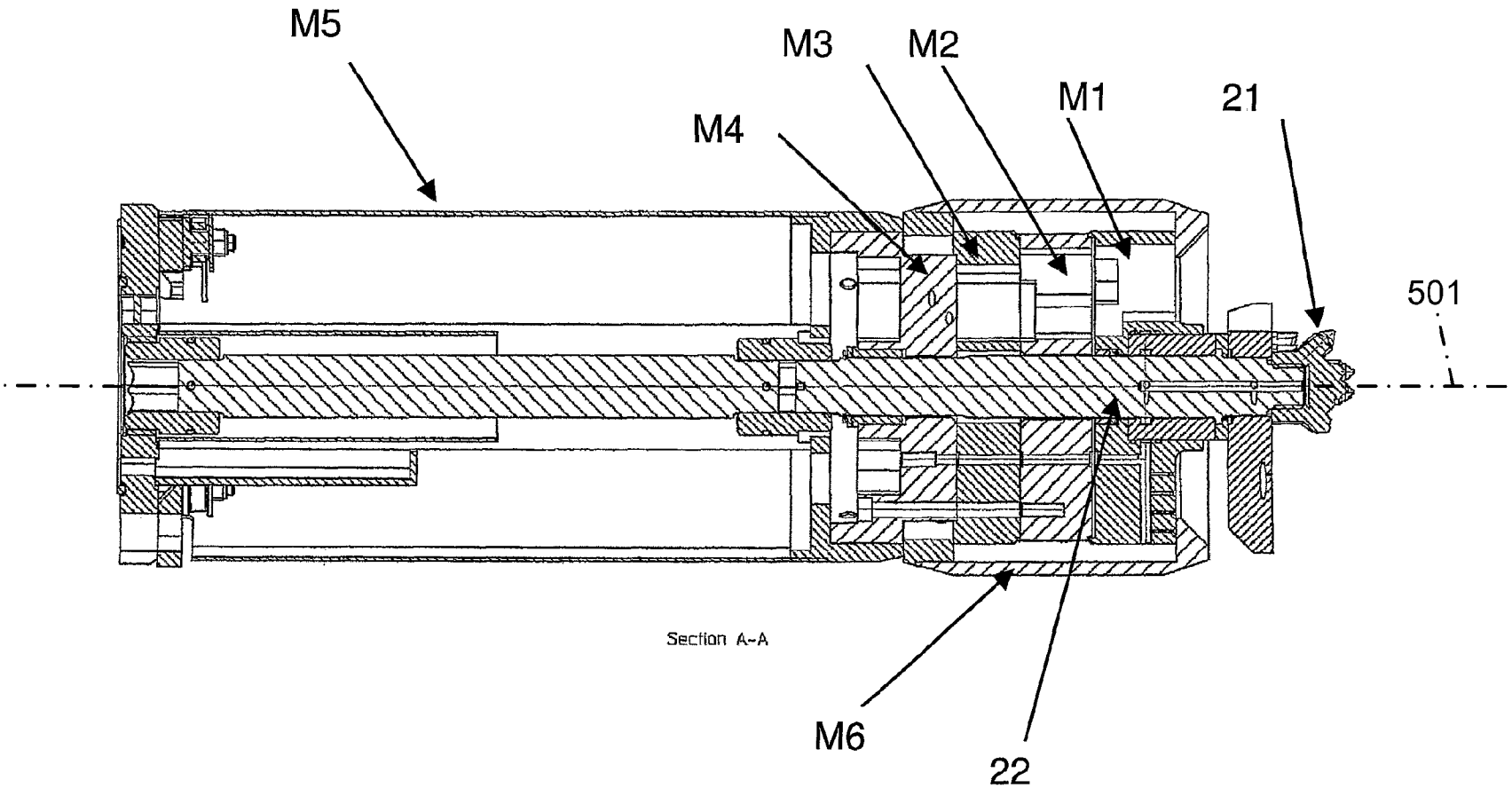
FIG. 4 is a cross sectional view of the enclosed drill head with front cutting means of FIG. 3 through section A-A.
Figure 5:
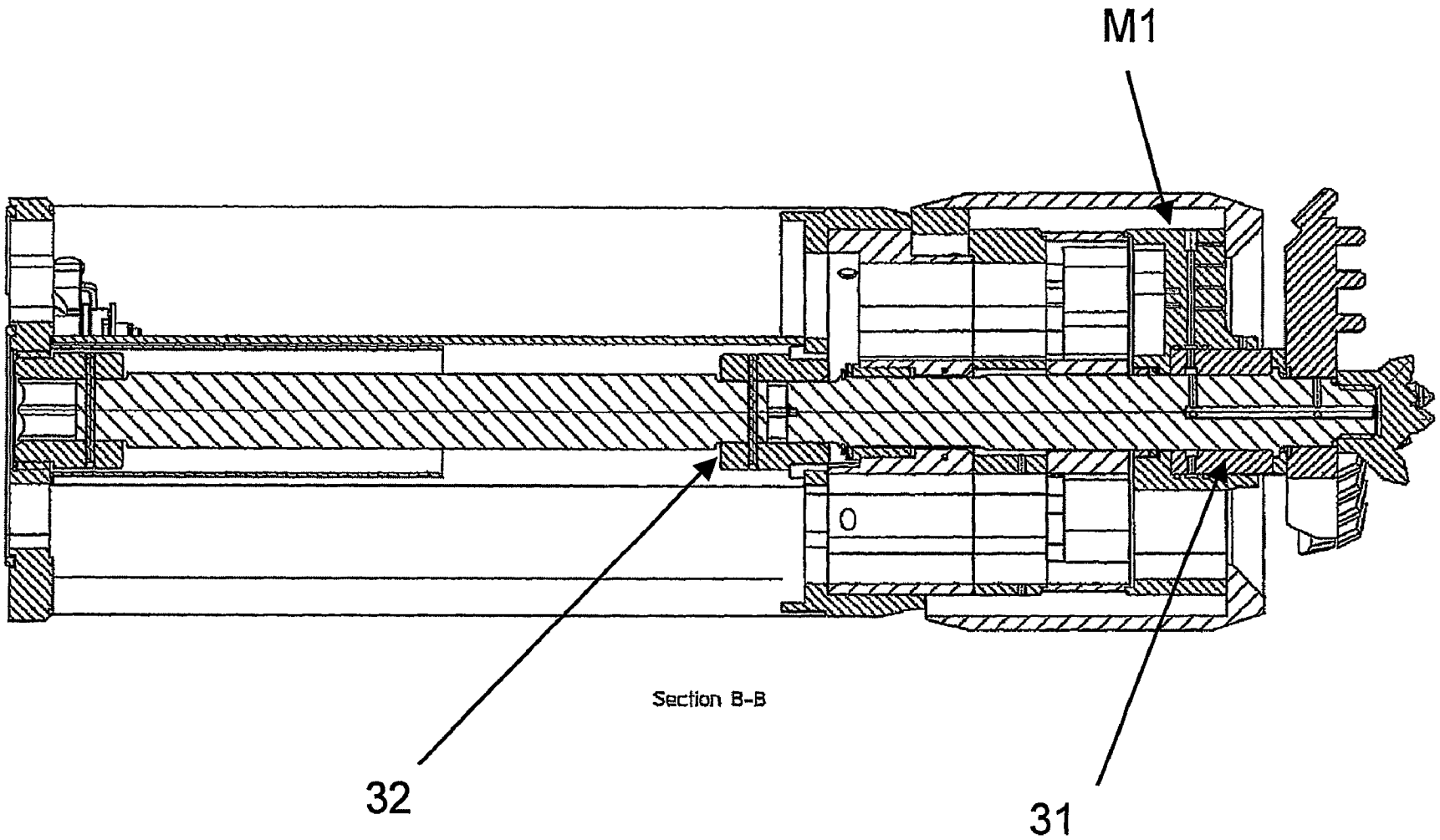
FIG. 5 is a cross sectional view of the enclosed drill head with front cutting means of FIG. 3 through section B-B.
Figure 6:
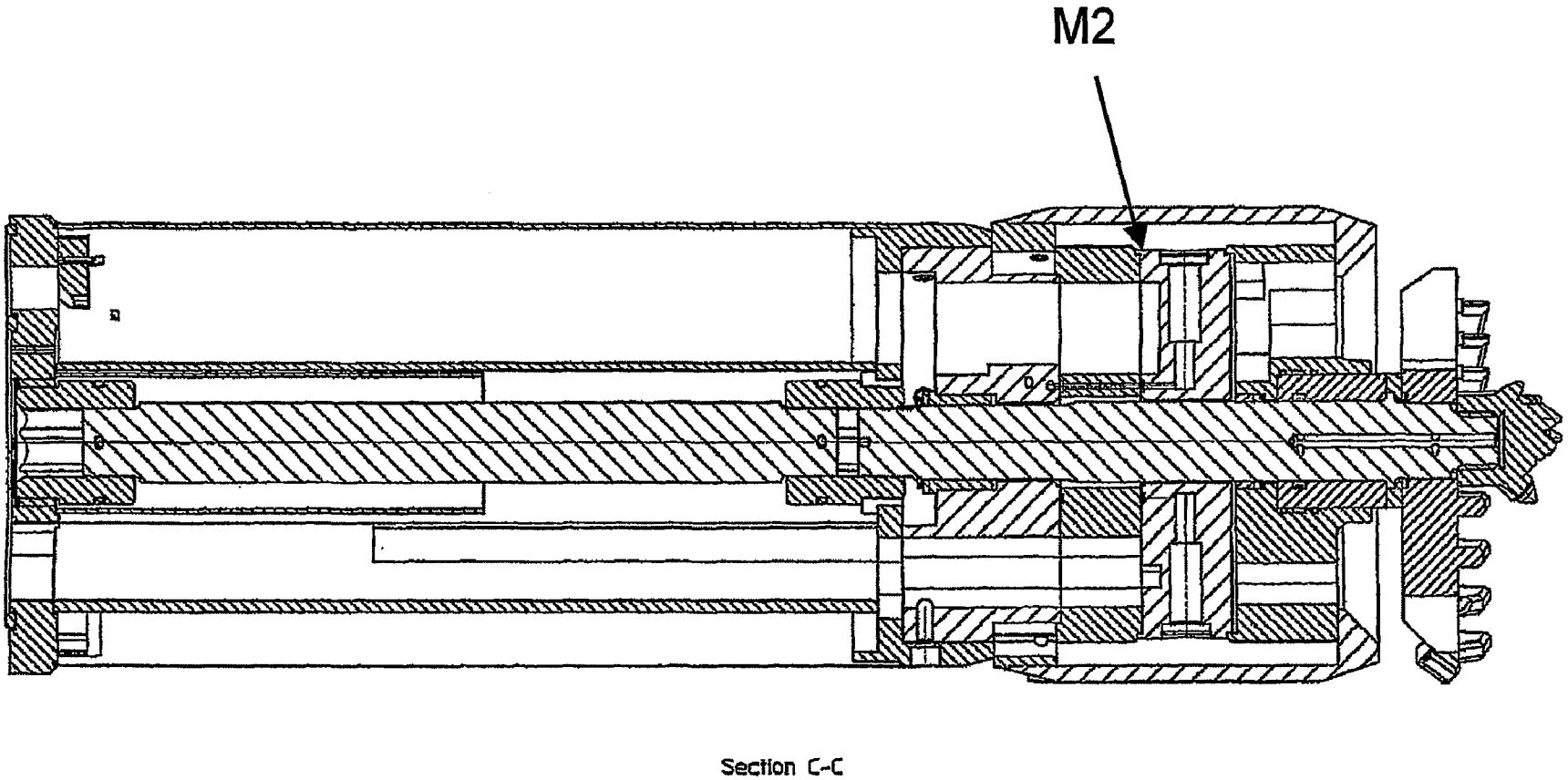
FIG. 6 is a cross sectional view of the enclosed drill head with front cutting means of FIG. 3 through section C-C.
Figure 7B:
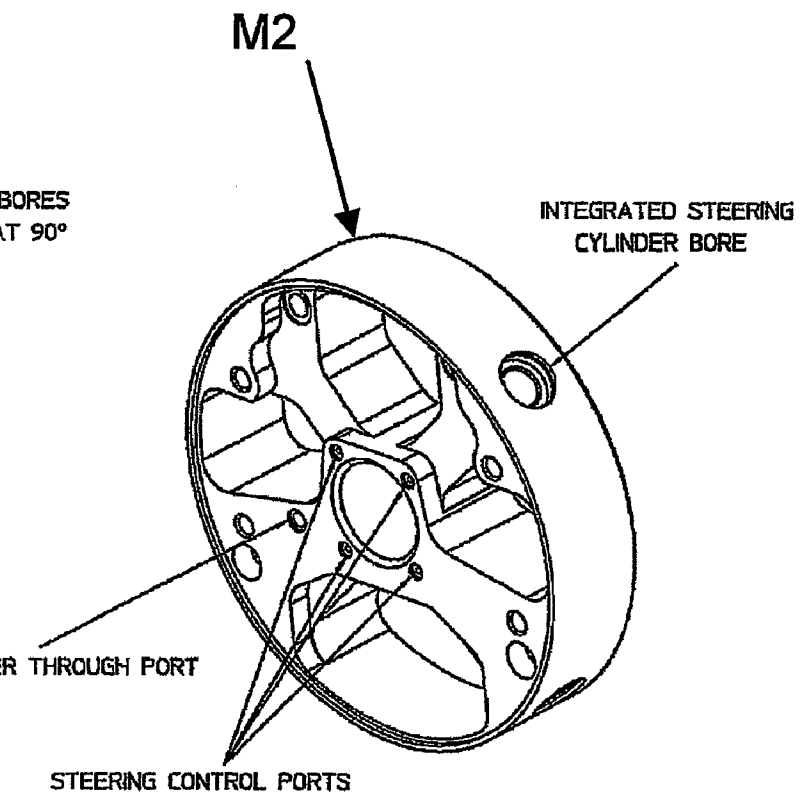
FIGS. 7A and 7B show front and rear perspective views of the steering module of the drill head of FIG. 2.
Figure 7A:
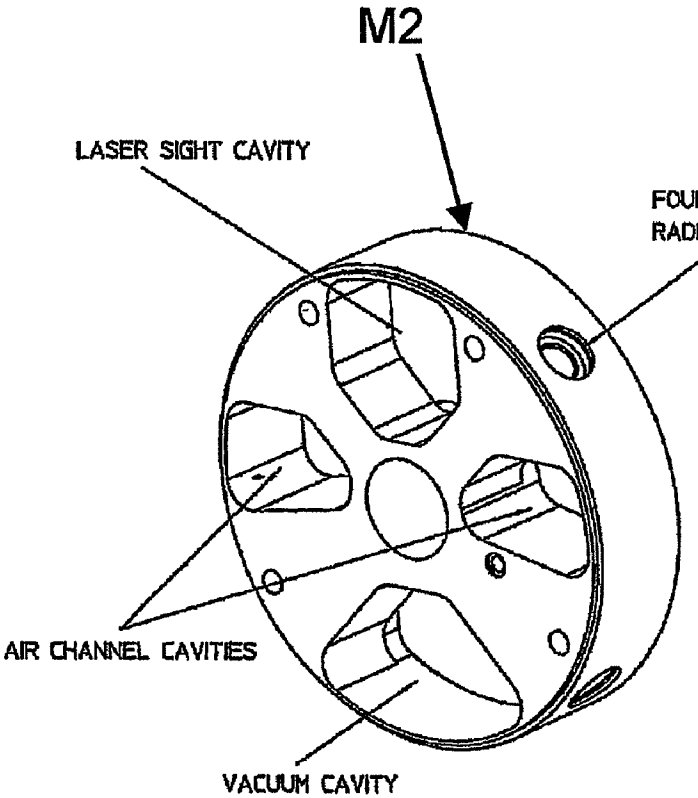

Attached to the distal end of the last intermediate drill rod (41) is attached a drill head (20) shown in exploded view in FIG. 2 and in cross sectional views in FIGS. 4, 5, and 6. As such a drill rotor assembly (21) connected to the end of the drill shaft or drill rod (22) and connecting to intermediate drill rods (23) form a continuous drill string that is driven by the external drive means (11) comprising the hydraulic thrust module (13), reciprocating a rotation module (14) and linearly movable on the rack and pinion gearing system (12).

Figure 16B:
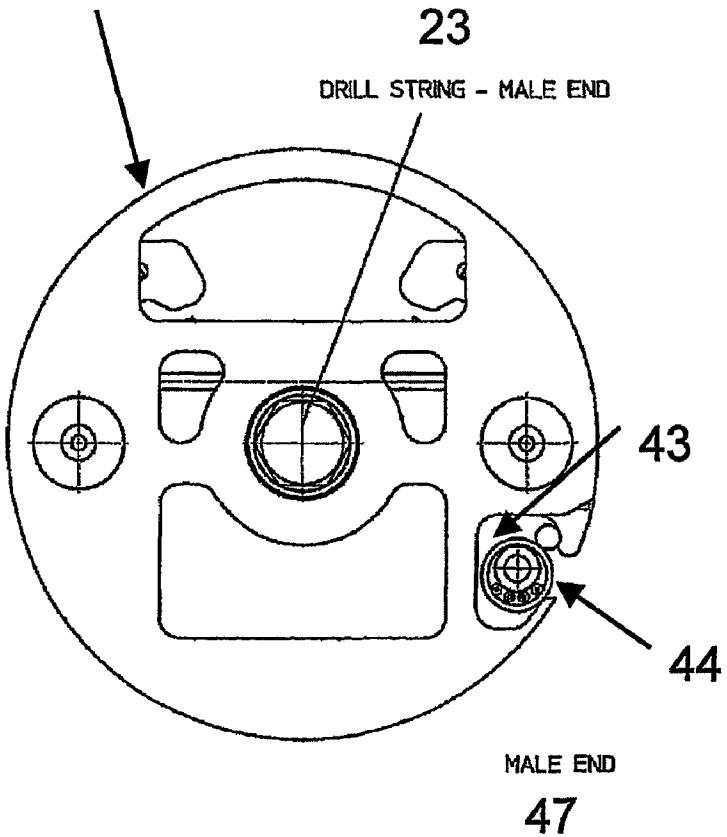
FIGS. 16A and 16B are respectively female and male end views of the drive rod of FIGS. 14 and 15.
Figure 16A:
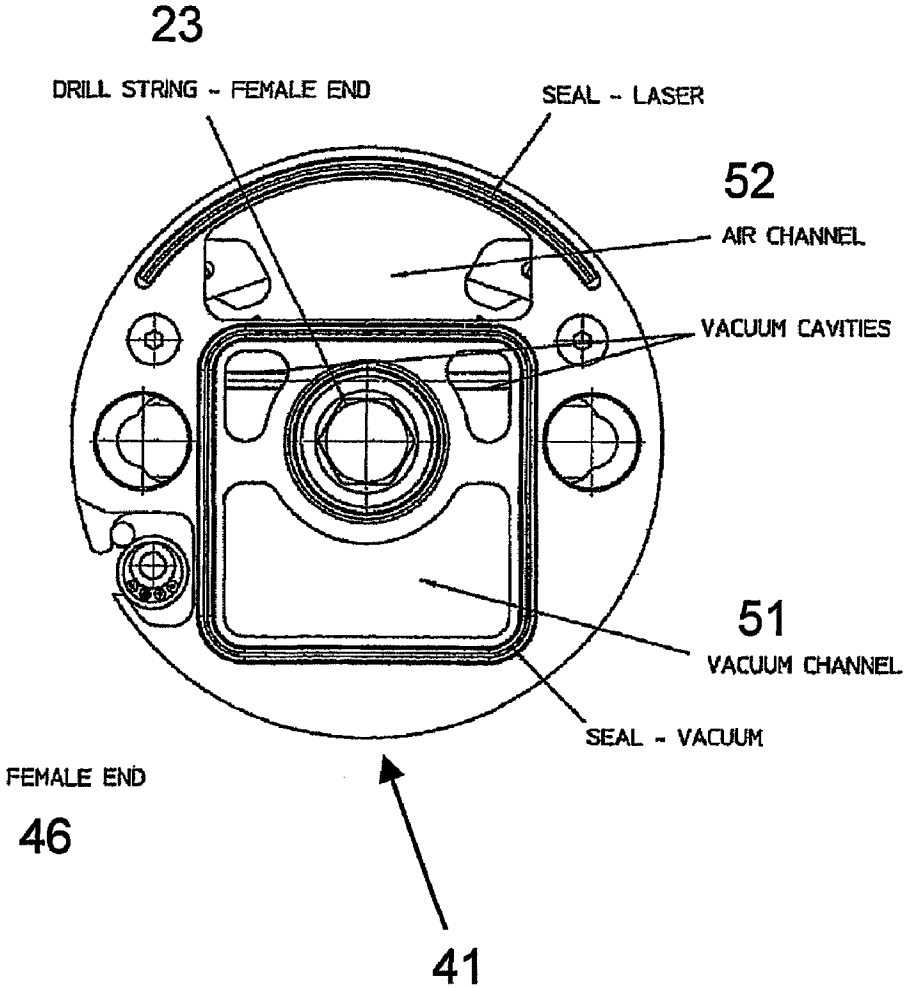

The casing (42) of the intermediate drill rods (41) and the casing of the drill head (20) formed by the steering shell (M6) and the rear shell (M5) form a continuous covering of the continuous drill string with internal defined continuous bores or channels. In particular a vacuum channel (51), as shown particularly in FIG. 16, can be formed by a number of continuous cavities extending along the length of the intermediate drill rods (41) to the drill head (20). This vacuum channel (51) has vacuum seals at connecting female end (46) to maintain vacuum between longitudinally engaged and aligned intermediate drill rods. Within this vacuum channel 51 is located the connecting intermediate drill rods (41). A separate air channel (52) is formed by a separate number of continuous cavities extending along the length of the intermediate drill rods (41) to the drill head (20). This forms a linear channel within which the controlling laser can penetrate to the drill head (20). By the separation of the heat generating drill rod (22) to the linear laser channel and the cooling effect of the return slurry along the vacuum channel (51) creates a highly effective and accurate steering mechanism.

The microtunnelling system and apparatus further includes:

a) drill head with fluid bearing bush and modular construction
b) enclosed drill rods with internal cooling system
c) pullback extraction reamer
d) rack and pinion thrust module with rotation unit
e) rod loading system
f) microprocessor control system.

In use upon excavation of a launching shaft, the base of the shaft would be prepared for the installation of the drilling machine. The shaft would typically have a pipe invert start point already marked and a line surveyed. A laser would be set up in the shaft at the extreme rear on line and grade. Thick boards are typically placed along the base of the shaft horizontally on grade. The microtunnelling drive means (11) including thrust module (13) and rotation unit (14) is lowered into the shaft and set up on line and grade.

The drill head (20) is lowered into the shaft and data, hydraulic and pressure fluid lines (44) are attached to the drill head (20). The drill head size and ground conditions are entered into the control panel which selects appropriate parameters for drill thrust speed and force, drill rotation speed and torque, vacuum flow and pressure, and pressure fluid flow. The drill head is attached to the vacuum thrust adaptor mounted on the rotation unit. Once set in launch mode, the vacuum unit is started and the pressurised drill fluid is actuated to eject at the drill face. The drill head is launched into the earth face.

The hole is cut via a combination of rotating cutting tooling and assisted by ejecting pressurised fluid. This pressurised fluid flow, which also acts as a fluid bearing, is shown in bold in FIG. 13. Whilst drilling, the drill head (20) is thrust into the ground with the slurry/spoil being vacuumed up back into vacuum pipe (15) into a waste tank for removal. Once the drill head is completely in the ground the thrust, rotation, vacuum and pressure fluid is stopped. The drill head is detached from the vacuum thrust adaptor, and the thrust trolley with rotation unit return to the starting position.

Figure 17:
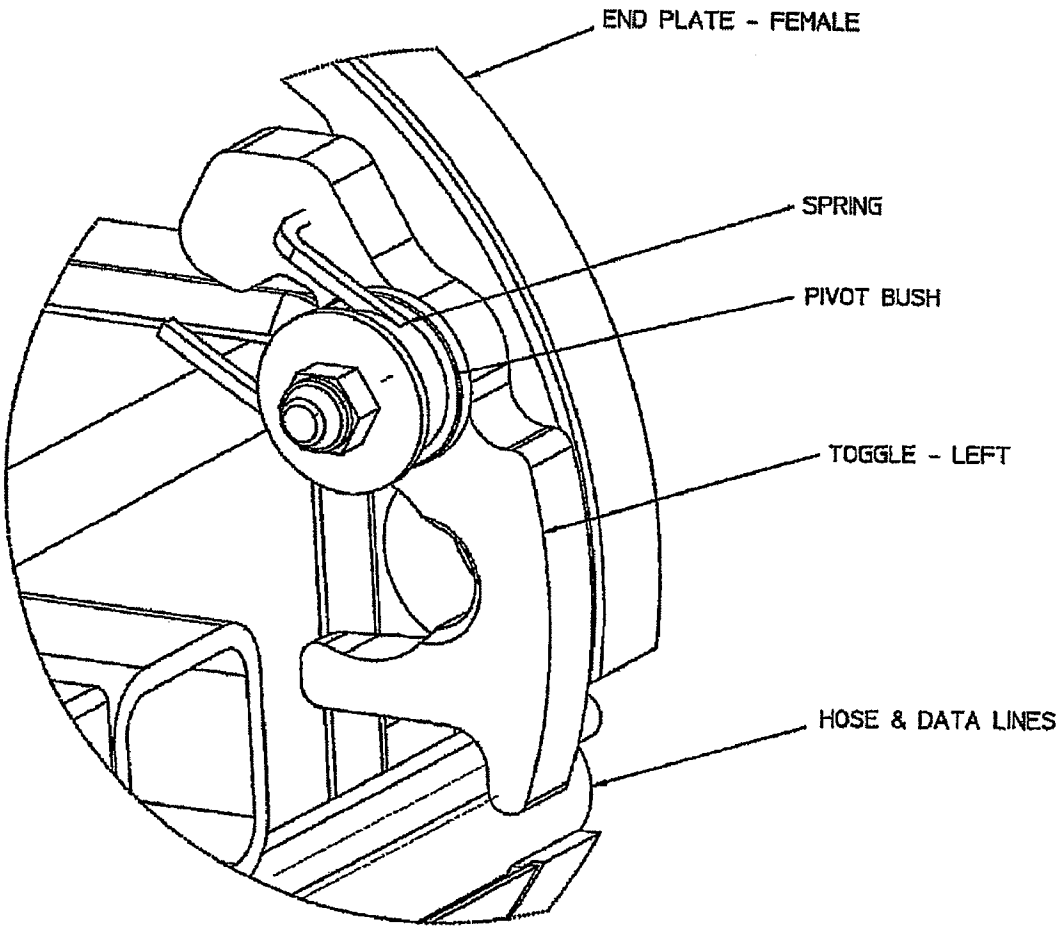
FIG. 17 is a perspective detailed view of the drill rod of FIGS. 14 and 15 showing the toggle locking mechanism.
Figure 18:
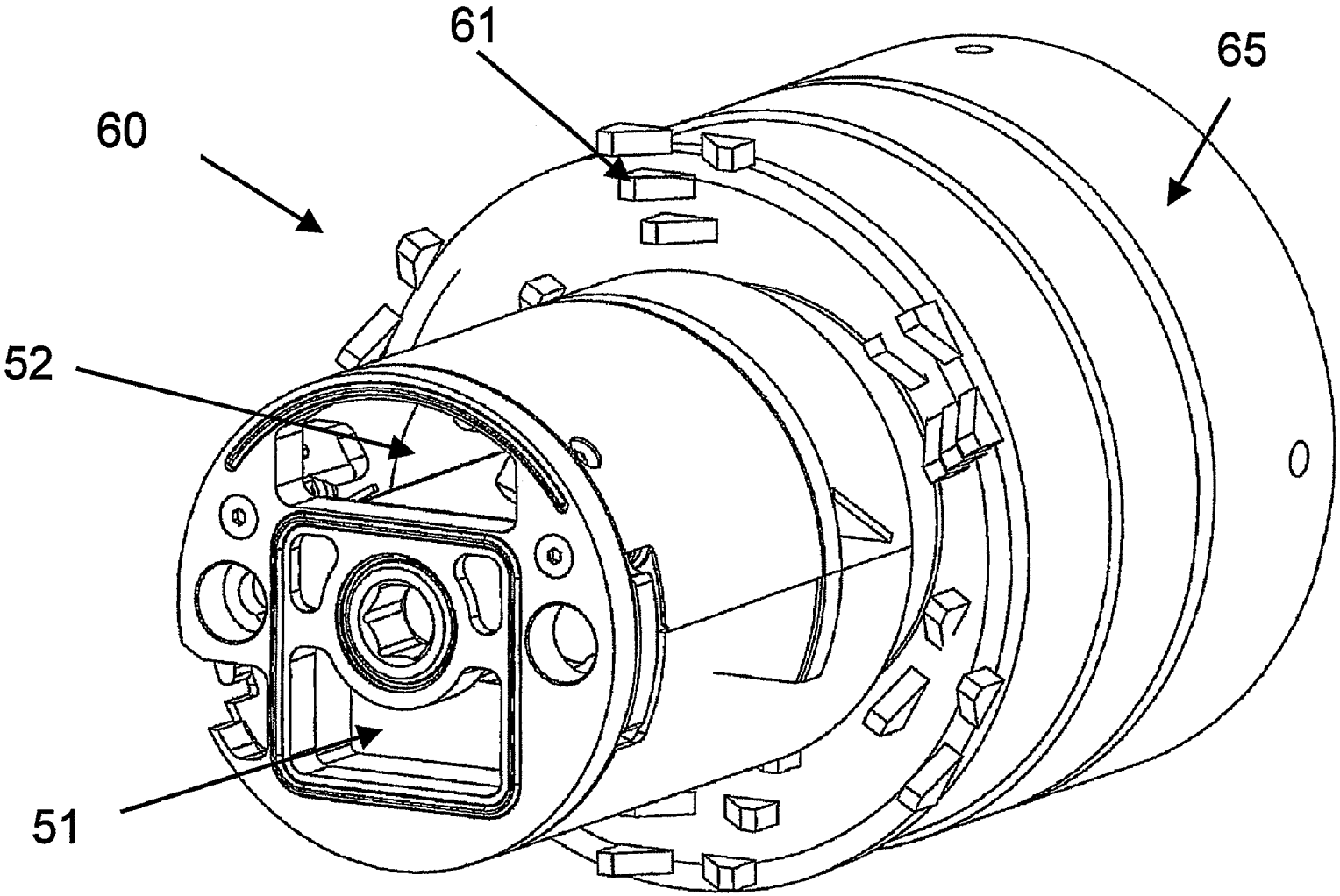
FIG. 18 is a rear perspective view of a vacuum assisted precision reamer showing the connection means to the drill rod and rearward facing cutting face.
Figure 19:
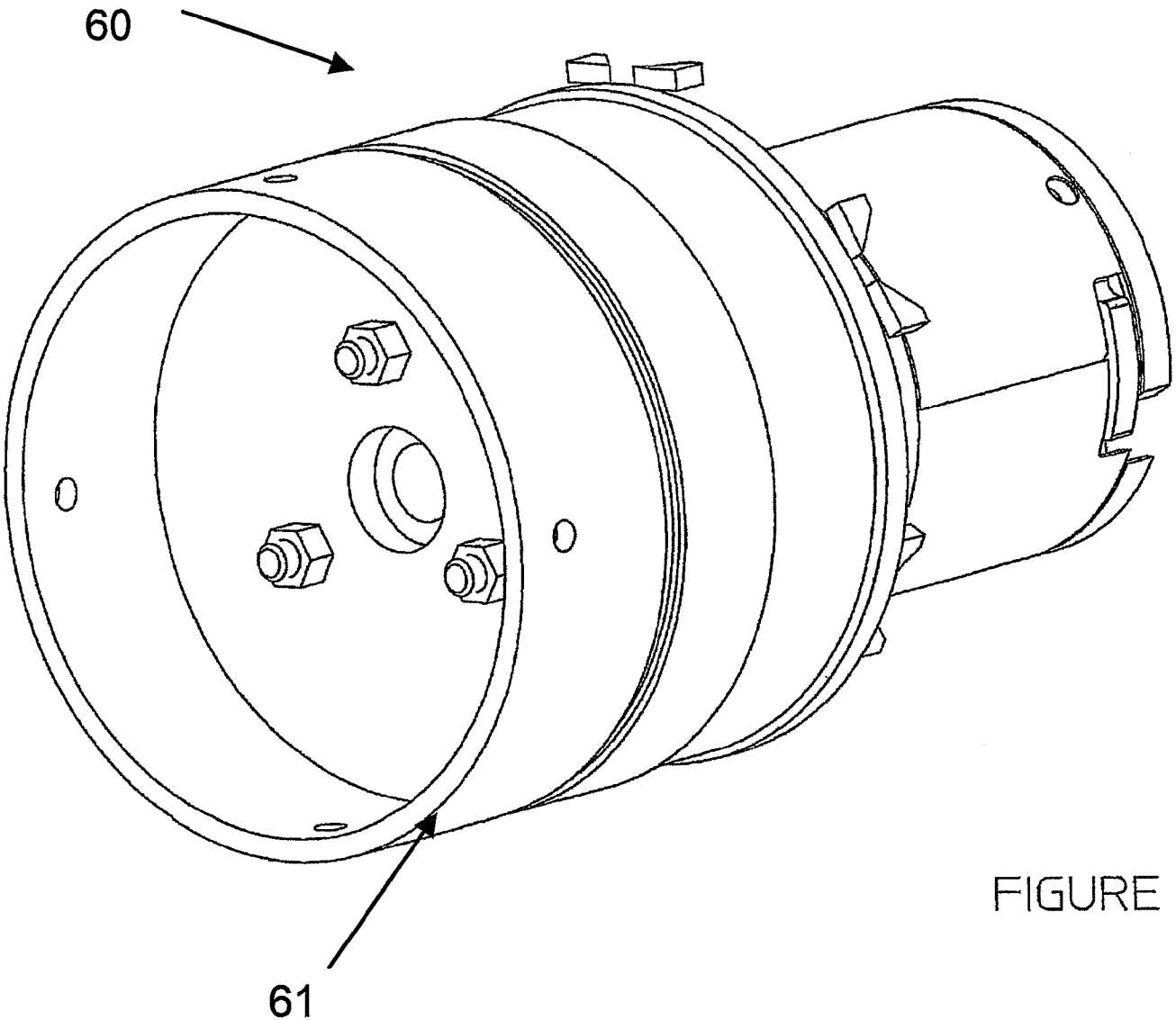
FIG. 19 is a front perspective view of a vacuum assisted precision reamer of FIG. 18 showing the connection means to the product pipe to be installed.
Figure 20:
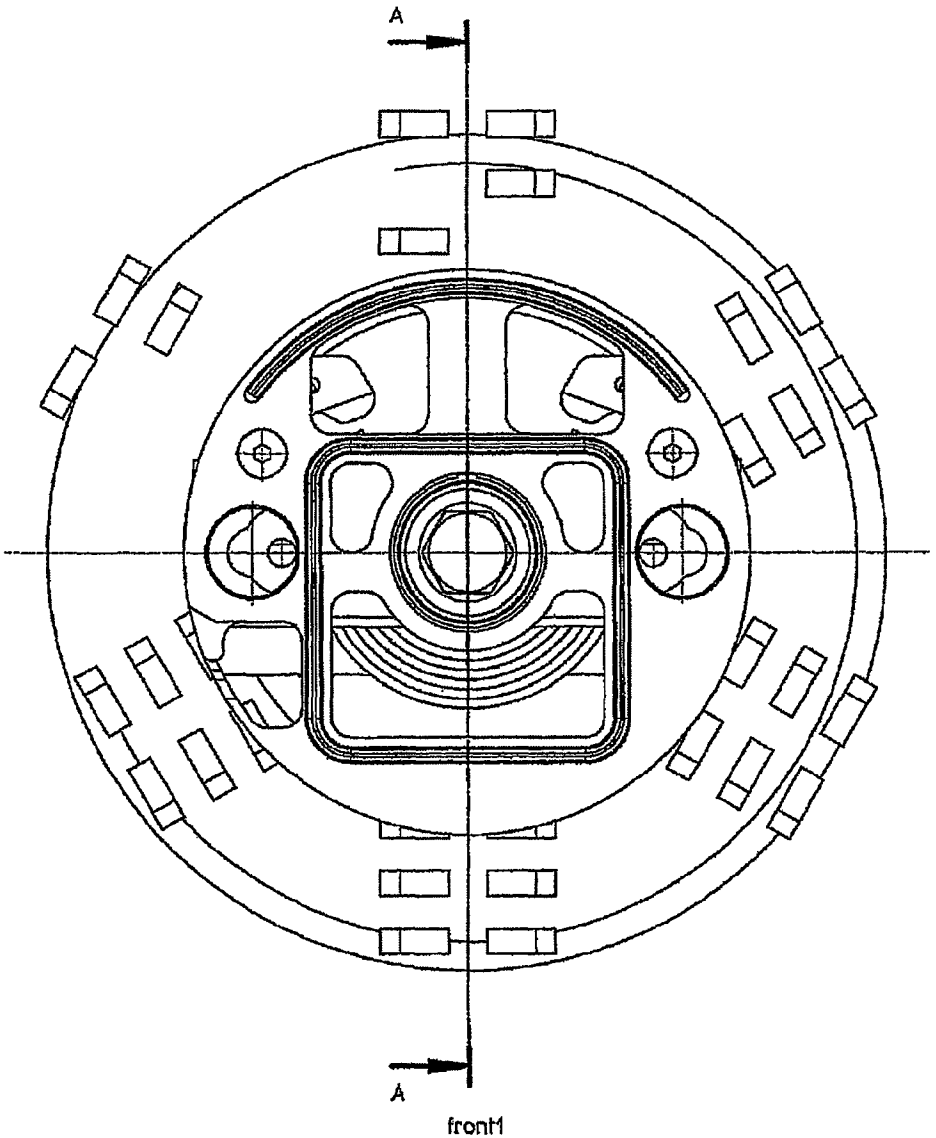
FIG. 20 is a rear perspective view of a vacuum assisted precision reamer of FIG. 18.
Figure 21:
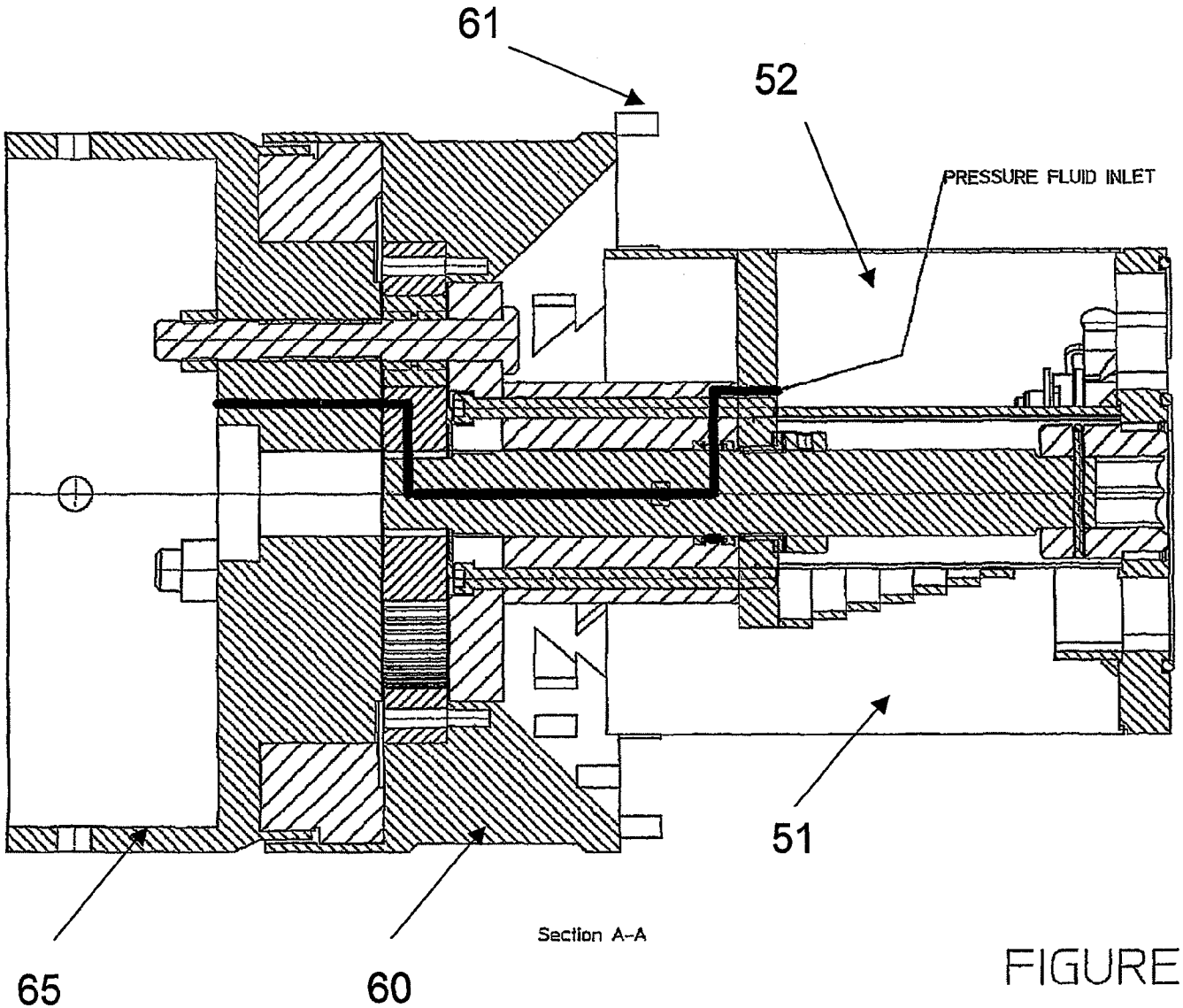
FIG. 21 is a cross-sectional view through section A-A of FIG. 20 of a vacuum assisted precision reamer of FIG. 18 showing the internal pressure fluid passages, vacuum cavity, air channel, input drive shaft, planetary gear set, cutter hub and bearing.

Once in the start position an intermediate drill rod (41) is loaded either manually with a crane or via the use of the automated rod loader. Once the drill rod is sitting in the bed of the thrust module the thrust trolley and rotation unit are started at low speed, low thrust and low torque respectively to engage the drill rod. The rod engagement is automatic in that the drill rod has self-aligning pins (48) that accurately aligns the rod to both the drill head and the drill machine. Upon full alignment and further forward travel, the self-locking toggles (shown in detail in FIG. 17) engage behind the locking pins to affect a solid connection. Control hoses and cables (44) are inserted into the concave cavity (43) of the outer cover or casing (42) encasing the drill rod (23). Vacuum and pressure fluid resume with the drilling process reverting to preset drilling speed, thrust and torque. This process is continued until the final bore end point is reached.

Operation of the microtunnelling machine is performed remotely via a control box, which displays all the current pressure and speed settings. The control box is computerised and integrates the control of the steering, thrust module, rotation unit, vacuum unit and the pressure fluid. The operator can adjust any of the parametric settings to perfectly suit the current ground conditions. Both the drilling process and the steering process can be automated via the use of integrated computer software and can also be manually controlled. Throughout the drilling process the drill position is monitored via the laser hitting a target positioned in the drill head (20) and viewed through the use of closed circuit television (CCTV) so that the operator or software package constantly steers the drill head to keep the laser in the centre of the target.

Once the bore is complete there are three options; progress the drill rods into the reception shaft whilst inserting jacking pipes, pull back to the launching shaft whilst trailing a pipe directly behind it, or remove the drill rods prior to pipe insertion.

Currently, the microtunnelling industry only allows for forward excavation. The current invention is the only system of microtunnelling that incorporates precision back reaming. As shown in FIGS. 18 to 21 there is provision for the drill head (20) to be replaced by a back reamer (60) that is similarly connected to the intermediate drill rod (41) and driven by the drill string and external drive means. However instead of forward facing drill rotor assembly (21) of similar diameter to the drill head (20), instead there is a rearward facing reaming assembly (61) of larger diameter to the intermediate casing (42). The pipe can be installed by back reaming and attaching pipe to open cylindrical end housing (65) mounted at the very end of the back reamer (60). Thereby as the back reamer (60) is drawn back by the drive means (11) while undertaking rotational drilling with rearward facing reaming assembly (61) of larger diameter, a pipe of same or smaller diameter is drawn along and laid in the enlarged bore.

Back reaming allows use of low cost reamers to open the hole for different pipe size installations. Back reaming also utilises one size drill head and drill rod for each thrust module which in turn simplifies the rod loading process and reduces overall equipment cost.

Looking at the apparatus in further detail the system includes:

- Guidance system with a laser striking a target, which is monitored to constantly maintain an accurate position.
- Vacuum: Use of vacuum allows for clean operation, fast extraction minimising regrind and Vacuum also reduces volume area occupied by extraction unit
- Pressure Fluid: Allows for enhanced cutter life whilst creating greater option via the use of drill fluid when dealing with different drill conditions.
- Drill rods: providing the ability to push or pull means that we can cut in both directions. This allows the machine to essentially drill a pilot hole accurately on the thrusting forward of the line and then cut back or open the hole as you pull back. As the line and grade of the hole is already determined the tooling required is simplistic and inexpensive which allows the machine to be more versatile through a large range of hole sizes at minimal cost. Pulling back in microtunnelling is unique. By only using one sized drill rod for each unit the jacking frame can be customised to automate the loading and unloading of the drill rods. With automated loading and unloading of drill rods the system reduced the need for man entry whilst operating. This enhances safety on the worksite.

The thrust module, which is installed in the launching shaft, can provide 300 kN force for thrust and pullback of 2.5 meter stroke within a longitudinal space of 3.0 meters. The thrust module uses rack and pinion gearing for increased stroke to retracted length ratio. It provides a high load capability with positive force. Pressure, force and speed are fully adjustable for both thrust and pull back and have a programmable stroke with adjustable limit stops for the trolley assembly. Overall the thrust module allows fast drop in boxes for the rotation unit.

A variety of rotation modules can be selectively utilised with the one thrust module according to the requirements. Rotation modules ideally cater for one drill diameter, by maximising available hydraulic power, rotating at ideal speeds (rpm) by maintaining optimum cutting face surface speeds (m/min) to best utilise working range of tungsten and carbide cutting inserts, and by maintaining the most desirable cut face/vacuum area ratio. Other sizes of rotation modules can also be used but with less efficiency.

Each rotation module comprises its own hydraulic motor (low speed/high torque, high speed/low torque, two-speed automatic selective unit, or other) coupled through a drive train assembly (chain and sprockets, simple gear box, planetary gearbox, or other) to rotate a drive shaft with a hexagonal end, which is to be coupled to the drill string inside the drill rods.

Each rotation module also includes a Vacuum thrust adaptor for connection with drill rods. This vacuum thrust adaptor incorporates the features suited to each drill rod, being vacuum sealing method, drill rod alignment, drill string torque transmission connection, thrust face and pullback connection. The Vacuum thrust adaptor also houses any hydraulic clamping and disconnection mechanisms for drill rods.

The microtunnelling machine targets extremely precise small diameter trenchless pipe installations particularly <600 mm and more particularly <300 mm. This is achieved by tracking a laser striking a target in the drill head, which is monitored via CCTV in the drill head and then steered accordingly to maintain line and grade. A unique fluid bush assembly transmits water and thrust to the rotating cutting face, where the pressure water and subsequent cutting spoil are mixed to a slurry for removal by vacuum extraction.

The drill head utilises a unique radial steering system capable of directly variable directional changes to continually and precisely cut the bore hole. The drill head is progressed through the ground by connecting subsequent drill rods between the drill head and thrust module until final bore length is achieved. These drill rods are either encased or open and combine rotation shaft/drill string, vacuum, air and control channels providing mechanical and control workings. Hydraulics, water and data is remotely controlled and utilised by the operator at the remote control panel and conveyed by cables and pressure hoses.

The front cutting rotor assembly consists of tungsten, carbide or other sintered hard metal inserts housed both axially and radially on a variety of face styles. The shape of the front cutting face varies remarkably with ground conditions, and can be flat, piloted or conical in shape and is built to suit.

All front cutting rotors are designed so that cuttings large enough to potentially block drill head vacuum cavity are kept ahead of cutters for further processing (mixing, cutting, grinding or shattering). Once cuttings are small enough, they are permitted past the cutter face for vacuum extraction.

A clay cutting face will have a multitude of spokes (range from 3 to 6) possibly connected together again to an outer rim. The main consideration is the clay consistency, as the openings through the cutting face are calculated to restrict cut spoil ahead of the cutter until small enough to be able to fit through the vacuum chamber of the drill head. When clay is soft it is easy to drill, but builds on itself and can cause blockages if the correct cutter is not chosen.

A shale cutting face will be similar to the clay version, but face openings are modified to allow for front regrind of large chipped material prior to vacuum extraction.

A rock cutting face generally comprises a cutter face with three, six or nine conical roller assemblies with peripheral openings (usually three) for cutting spoil extraction. Utilising multiple small diameter conical rollers, each set of three are staggered in distance and angle from the front face. The inner set of three cones being most forward, the intermediate set radially skewed from the inner at 60 degrees and setback by 25-100% of the cut diameter, and the final set again radially skewed from the intermediate at 60 degrees to bring the inner conical portion back in line with the radial centre-lines of the inner set of cones, and setback from the intermediate face by another 25-100% of the cut diameter. Roller cutter face then has the benefit of continual steering capability, increased stability in non-homogenous ground conditions, and increased chip rate resulting in less regrind time prior to vacuum extraction of spoil.

Downhole drilling technology has been using "tri-cone" rollers to cut rock for decades. They are available in a variety of grades—soft, medium and hard formation. A tri-cone roller utilises three conical rollers, equispaced at 120 degrees, fitted with hard metal inserts each rotating about their own bearing shaft. The conical shape of each roller, tapered into the centre of the cutting face, rotating about an axis skewed 60 degrees forward in towards the centre of the cutter results in a full flat face cut diameter. The resultant large flat cutting face is very difficult to maintain stability in non-homogenous ground, and due to the size of three rollers required to obtain the full cut diameter, the axial distance traveled prior to any steering response is often half the cut diameter.

Figure 13:
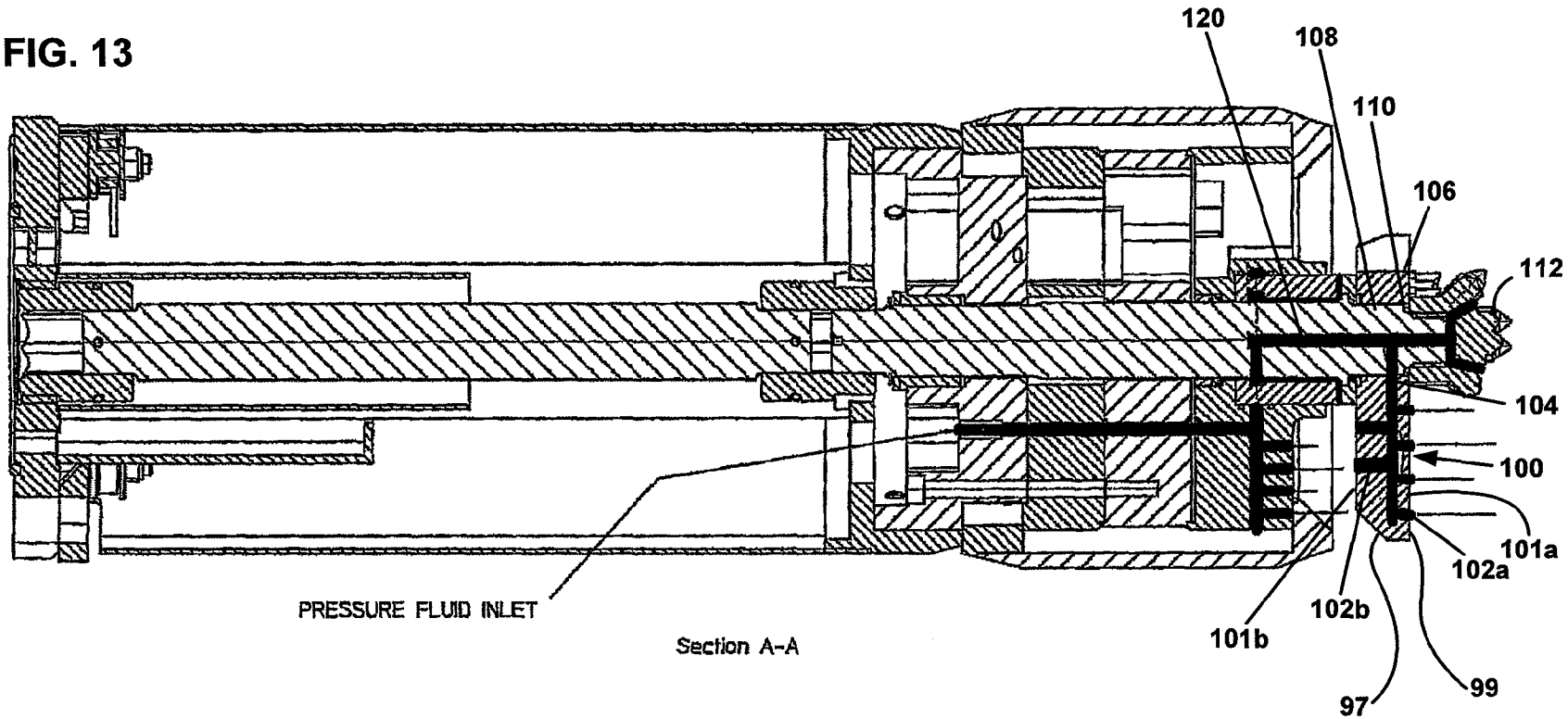
FIG. 13 is a cross sectional view of the enclosed drill head showing the pressure fluid path through the modules to the bearing module and the front bearing bush supporting the front cutting arm.

All front cutting rotors 100 are shown including cutting bars 99 having front and rear sides 101*a*, 101*b* that respectively define front and rear pressure fluid ports 102*a*, 102*b* (i.e., fluid discharge ports, see FIG. 13). Holes (i.e., fluid passages 104) are drilled radially to the centre of the cutter to coincide with the porting on the drill shaft 114. Additional holes are drilled axially from both the front and rear faces of the cutter. These holes are sized approx 2 mm diameter to allow extreme pressure at face for best cutting and mixing qualities with minimal pressure fluid usage. An internal chamfer on front ports 102*a* to increase surface area at opening only to allow for blockage ejection. Rear ports 102*b* are directed back towards drill head to aid in clearing any residues from air channel and vacuum cavity. Outer ends of the cutting bars 99 include angled relief surfaces 97.

Figure 3:
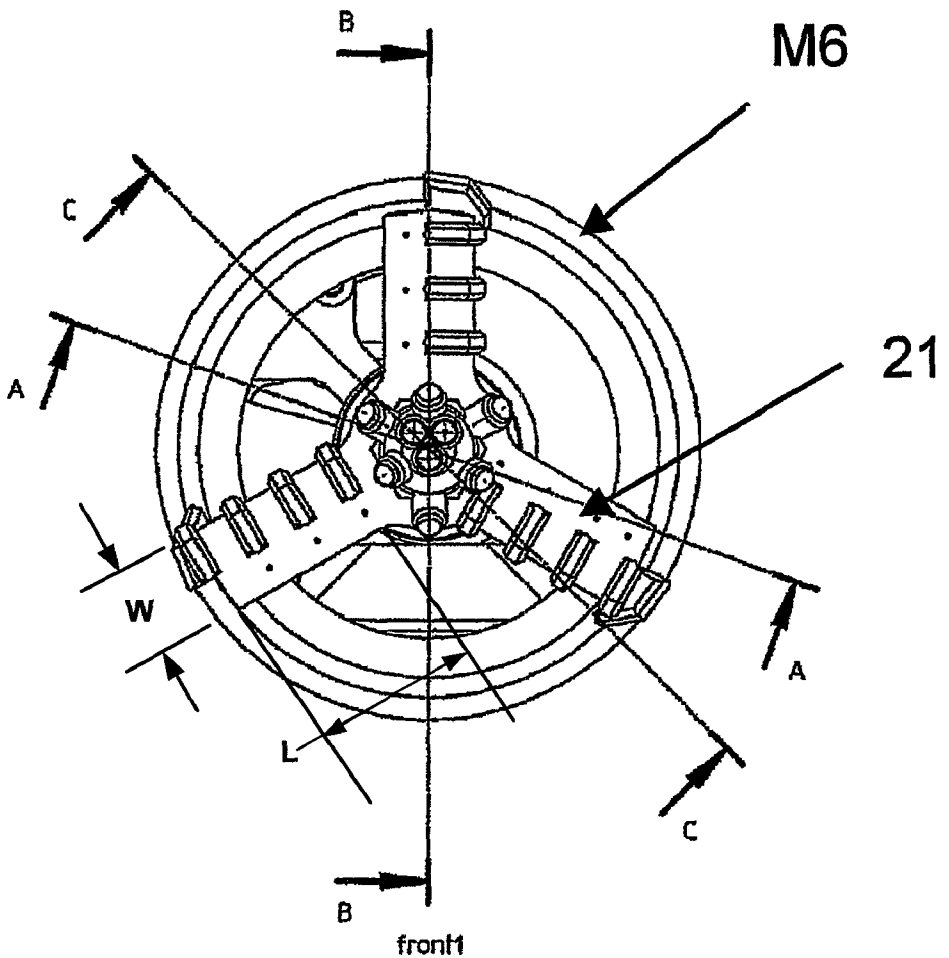
FIG. 3 is a front view of an enclosed drill head with front cutting means able to be driven by the drive means of FIG. 1 for use in the microtunnelling system and apparatus in accordance with the invention.

All front cutting rotors 100 have a central cavity 108 for connection with the drill shaft 114 in the drill head. This cavity 108 is either threaded with a trapezoidal or acme thread taking up onto a shoulder on the shaft, or a hollow hexagon (i.e., a hexagon having flats 110) for the quick connection arrangement used in conjunction with a front threaded cone (i.e., a front retainer 112) and lock bolt. Both styles accommodate for through shaft and cutter pressure fluid transmission. The cutting bars 99 project outwardly from a hub 106 of the front rotor 100. The cutting bars 99 have lengths L (see FIGS. 3 and 4), widths W (see FIG. 3) and depths d (see FIG. 4).

The cutting bars 99 project outwardly from a hub 106 of the front rotor 100. The cutting bars 99 have lengths L (see FIGS. 3 and 4), widths W (see FIG. 3), and depths d (see FIG. 4). The depths d extend in a front to back orientation along an axis of rotation 501 of the front cutting rotor 100.

The drill head drives the front cutting rotor 100 by way of the drill shaft 114. The front of the shaft 114 is a male hexagonal drive having flats 116 (see FIGS. 10A-10D), with 75-100% of across flats dimension of the hexagon in length, with a front threaded extension 118 generally 50-75% of the across flats dimension of the hexagon in diameter, and 75-100% of the thread diameter in length.

The drill rod is radially drilled (eg 3×5 mm diameter holes at 120 degrees) through the faces of the hexagonal final drive through to a central larger axial port (i.e., a fluid passage 120) (eg 8 mm-12 mm diameter). This axial port is drilled as a blind hole into the drill shaft, to the length corresponding to the position of the front fluid bush. Here, another series of smaller radial holes are drilled through to meet with the axial port (eg 3×5 mm diameter holes at 120 degrees). These holes are peened (eg 8-10 mm concave diameter) to eliminate any seal degradation from the rotating shaft.

The front fluid bearing bush encapsulates this mid-front section of the drill rod and provides a centralized bearing location capable of high radial and thrust forces combined. The peened radial holes of the drill rod are longitudinally aligned with the internal radial pressure fluid distribution groove of the fluid bearing bush.

This groove is in turn fed pressure fluid from radial drill holes (eg 6×5 mm diameter holes equispaced at 60 degrees). Fluid cannot escape to the rear of the fluid bush due to an energising U-cup seal placed at the rear of M1 bearing module. Pressure fluid is proportionally distributed—to the drill shaft axial port through to the front cutting rotor, creating back pressure to distribute to the annulus area between the outside diameter of the drill rod and the inside diameter of the fluid bush. This is achieved by high helix angle, low depth multi-start grooves machined on the inside of the fluid bush from the front edge of the distribution groove to the front face of the fluid bush (eg triple-start, 20 mm pitch 0.5 mm deep grooves with 1.5 mm concave radius). This pressure fluid is then channeled to a helical spiral groove on the front face of the bush (eg single 10 mm pitch continuously decreasing right-hand 0.5 mm deep face groove with 1.5 mm concave radius). This channeling effect essentially hydrostatically separates the shaft from the bush both radially and axially, to counteract steering and thrust face forces. The relationship is linearly proportional in that the higher the load, the harder the faces act against one another, providing a greater hydrostatic seal, which in turn acts to repel the two components. Hence we have a bearing, which mechanically transfers load, provides a pressure fluid swivel, and continually lubricates and cools itself. This method allows a very strong shaft construction with minimal stress riser points, and excellent pressure fluid conveyance.

The drill head functions to drive the front cutting rotor by means of a drill rod. The bore hole position is monitored within the drill head by means of a laser set at the launch shaft indicating a position on a target mounted in the drill head. A camera within the drill head is directed at the target, and relays a video image to a video screen viewed by the machine operator. The operator controls any required steering direction changes. Steering is achieved by altering the position of the cutting face relative to the bore hole.

The prior art was to manufacture a cylindrical drill head, and moving the cutting face. One steering method is to pivot the front portion of the drill head vertically and horizontally. Although effective in steering, this required the laser target to be situated a considerable distance from the cutting face. The further rearward the laser target position, the further the distance is required to be drilled prior to an update of current bore face location.

Another steering method is to move the drill shaft within the drill head. This has the advantage of being able to mount the laser target further forward in the drill head, and therefore, providing a more accurate target to bore face position. However, the pivotal mounting of these steering mechanisms provides a weak steering with high failure rates and increased maintenance.

These past methods of steering are physically large and cumbersome, and due to plumbing required to each hydraulic cylinder, makes this method unsuitable to small diameter drill head design. The invention entails construction of a modular drill head for increased strength and reduced size.

The drill head is of a segmental modular design to minimise overall size while achieving maximum strength and durability. Each module is centralized and retained by the next module by male and female stepped spigots. Clamping of each module achieves angular alignment and axial clamping. Each module is designed for its particular purpose in the drill head, and all hydraulic, fluid, air and vacuum channels are interconnected by way of stepped face seals. It is this method of construction that allows the use of integrated pressure porting, reliable bearing design, maximum vacuum area, good air channel ducting, maximum forward position of laser target area and plumb indicator for visual head tilt indication.

The drill head and steering module for use in the microtunnelling system has a steering shell M2 mounted axially on the drive rod (22) in a manner to allow radial movement and having a plurality of radially mounted pistons able to engage the inner surface of the steering shell M6 such that the control of the protrusion of the plurality of radially mounted pistons controls the direction of the steering shell.

Figure 8A:
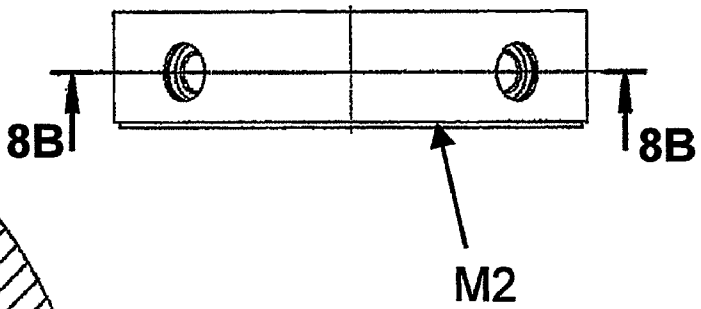
FIG. 8A is a side view of the of the steering module of FIGS. 7A and 7B.
Figure 8B:
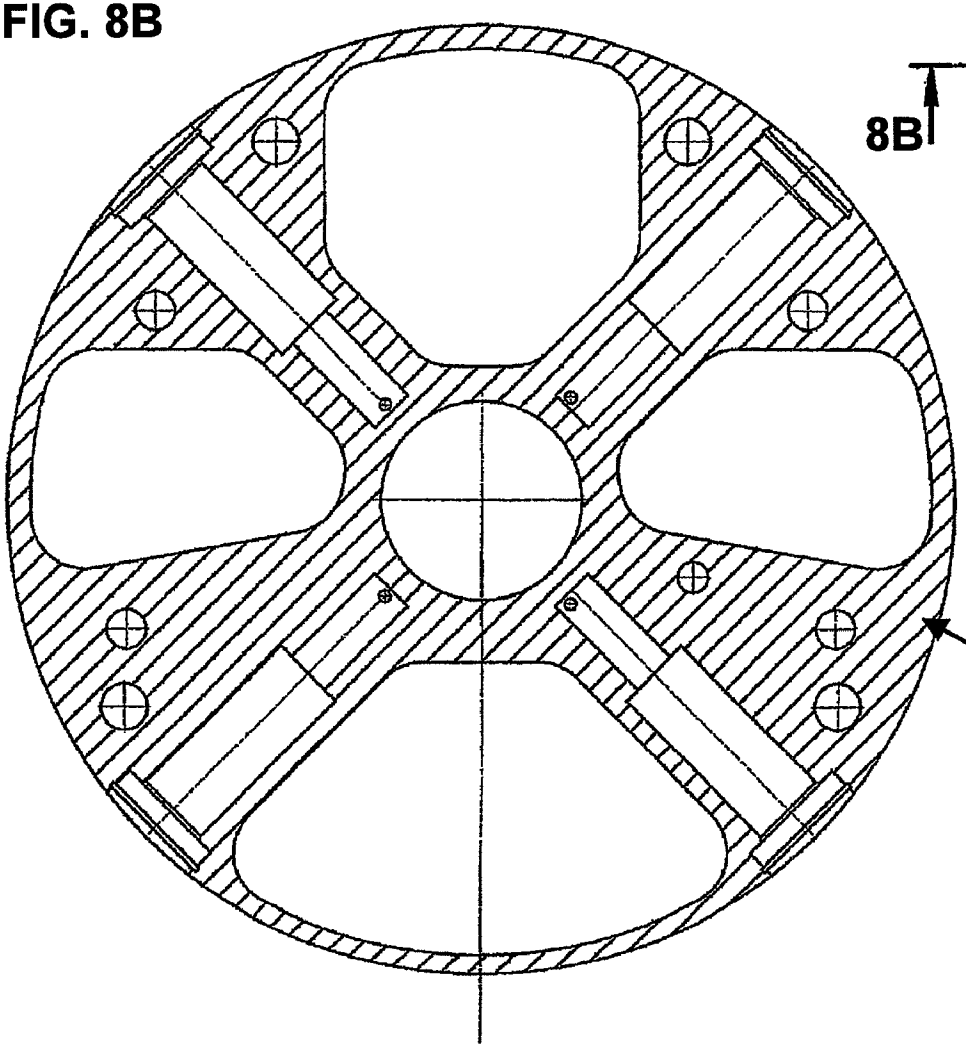
FIG. 8B is a cross sectional view through section line 8B-8B of FIG. 8A.
Figure 9B:
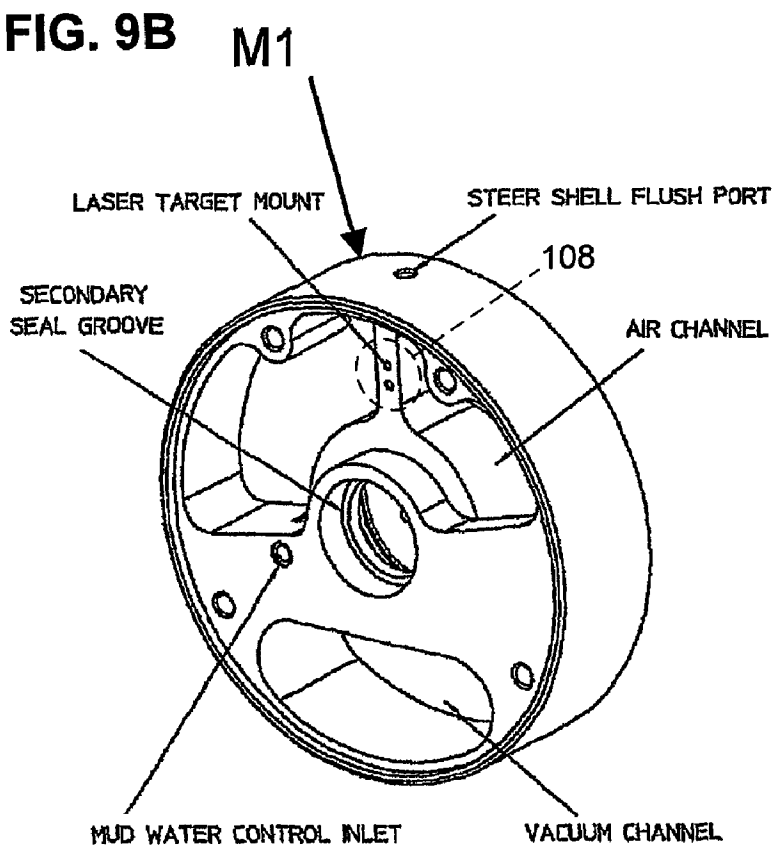
FIGS. 9A and 9B show front and rear perspective views of the bearing module of the drill head of FIG. 2.
Figure 9A:
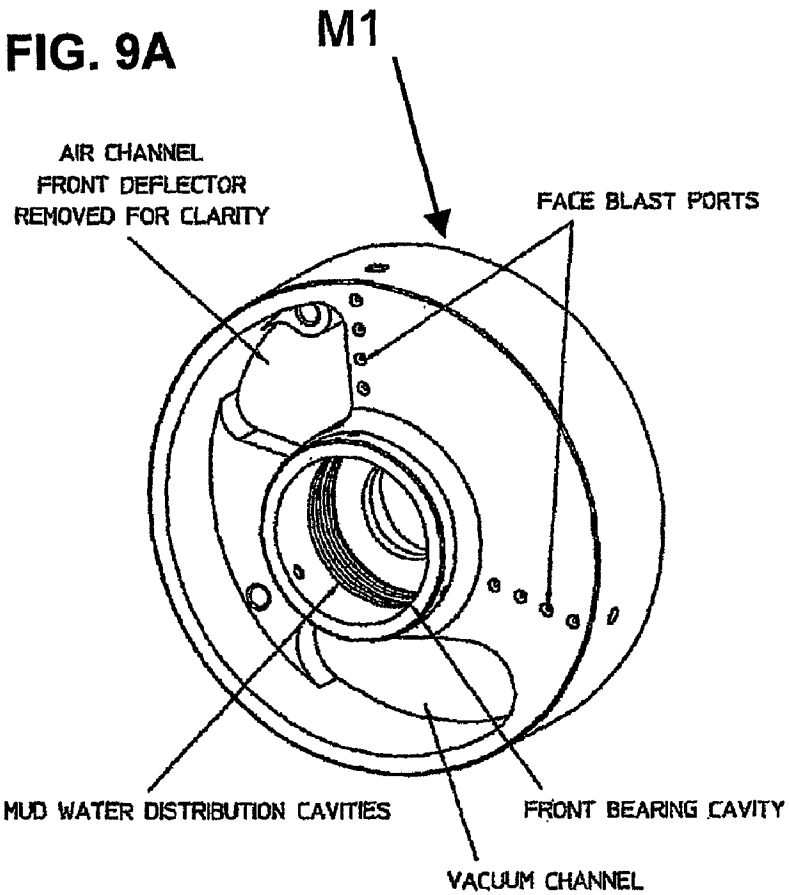
Figure 10B:
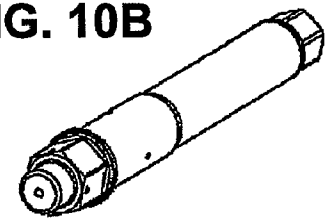
FIG. 10B is a perspective view of the drill shaft of FIG. 10A.
Figure 10A:
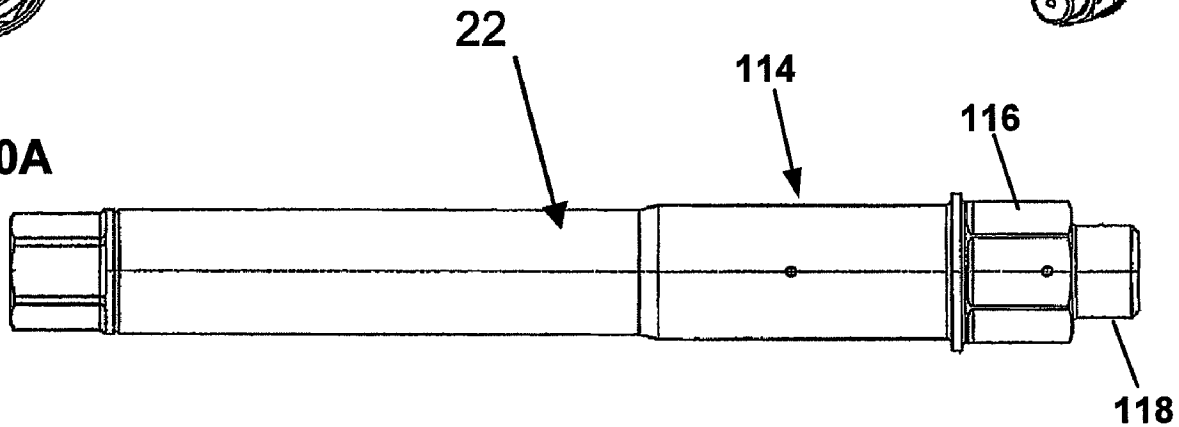
FIG. 10A is a side view of a drill shaft.
Figure 10D:
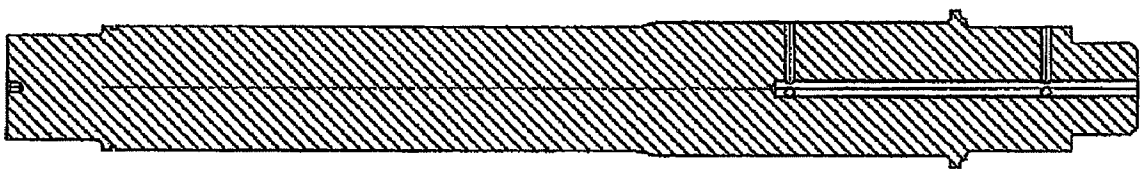
FIG. 10D is a cross sectional view taken alone section line 10D-10D of FIG. 10C.
Figure 10C:
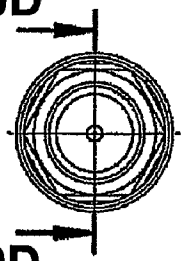
FIG. 10C is an end view of the drill shaft of FIG. 10A.
Figure 11A:
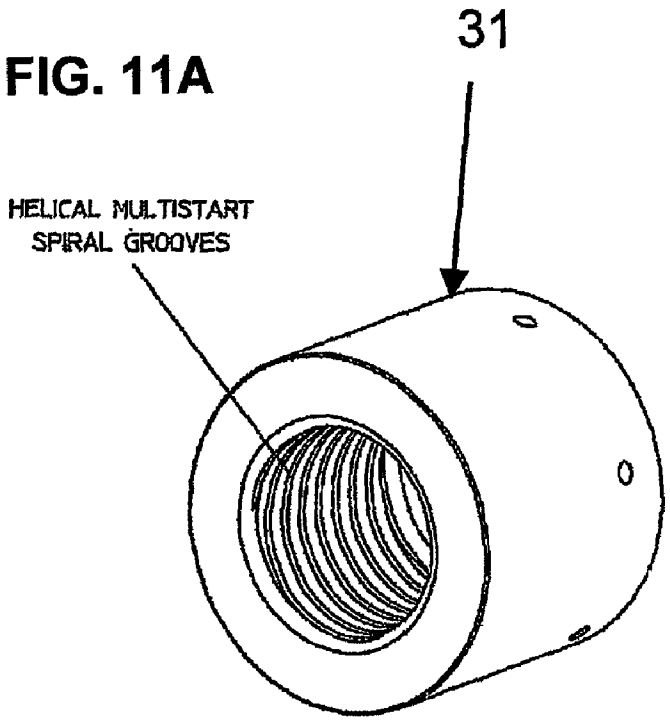
FIGS. 11A and 11B show front and rear perspective views of the front bearing bush of the drill head of FIG. 2.
Figure 11B:
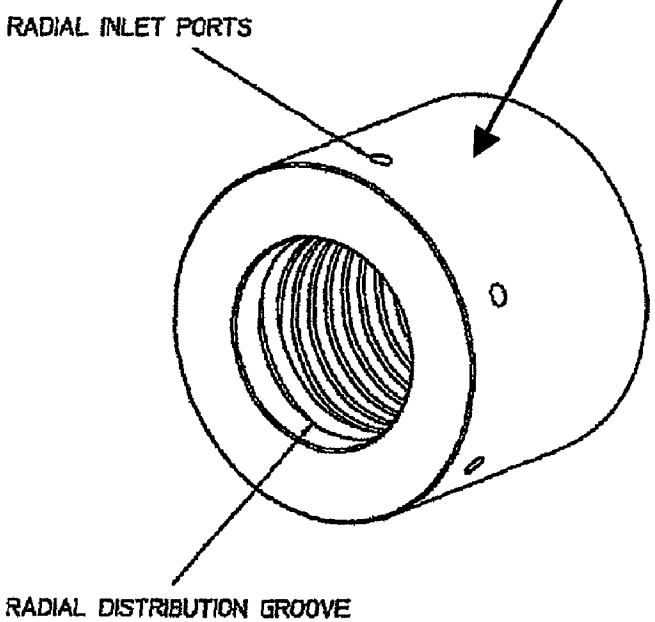
Figure 12B:
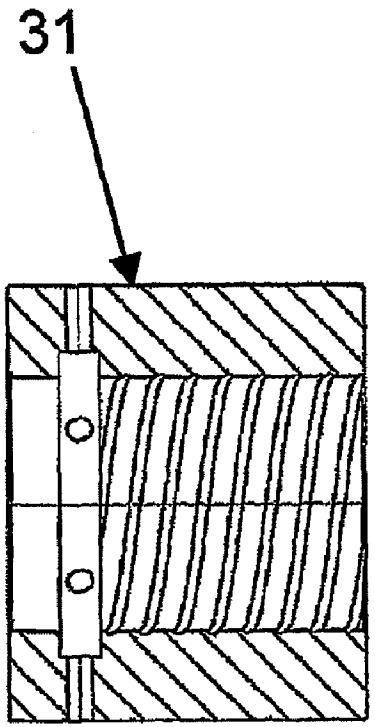
FIG. 12B is a cross sectional view through section line 12B-12B of FIG. 12A.
Figure 12A:
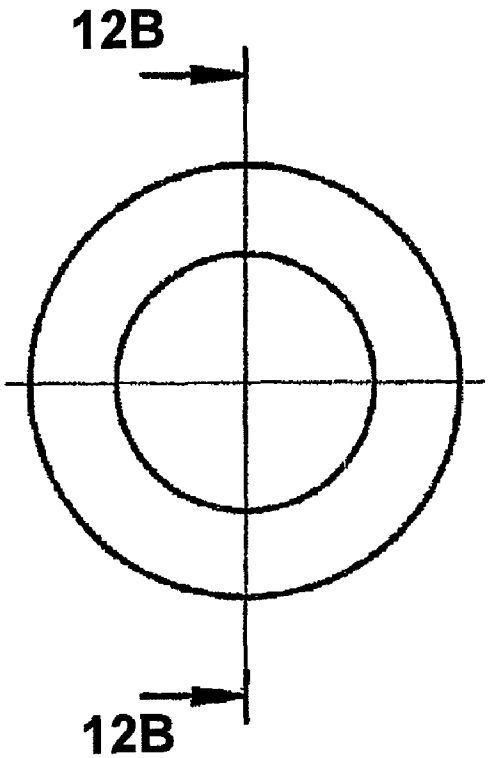
FIG. 12A is an end view of the front bearing bush of FIGS. 11A and 11B.

As shown particularly in FIGS. 8A and 8B, the plurality of radially mounted pistons is included in a circular steering module fitting around the drill rod and having radial bores from which the radially mounted pistons protrude. The circular steering module includes a spoked wheel effect with the radial bores extending at least partially along the radial extending spokes. Preferably cavities are between the spokes to allow axial pathways. The circular steering module includes ports near the radial centre and able to receive water or hydraulic fluid for driving the pistons to protrude from the radial bores and engage the inner surface of the steering shell.

As shown in FIG. 2, the drill head includes a modular construction having a plurality of circular disc like elements for axial alignment and abutment and mounting within a cylindrical shell, wherein each of the circular disc like elements is created by direct bore construction and the axial alignment and abutment creates continuous axial and radial channels allowing fluid flow, vacuum waste return channel, and control flows.

One of the circular disc like elements forms a bearing module M1 at the front of the drill head with flow paths for providing axially extending fluid jets to assist cutting and radially extending flow paths to assist aquaplaning bearings of the rotating cutting means.

One of the circular disc like elements forms a steering module M2 at the front of the drill head with flow paths for providing axially extending fluid jets to control protrusion of pistons to engage the outer cylinder and alter direction of the drill head.

One of the circular disc-like elements forms a spacer module M3 within the drill head with flow paths for providing axially extending flow paths to adjacent modules.

One of the circular disc like elements forms a mounting module M4 at the rear of the drill head with flow paths for providing axially extending flow paths and able to form non rigid mounting of base of outer cylinder.

The drill rod (22) and connected intermediate drill rods (23) are a steel rod drive shaft, with male and female hexagonal ends to effect connection and resist torsional forces. The drill rod and connected intermediate drill rods are retained within either end of the drill rod end plates by front and rear rod bush bearings. The drill rod and connected intermediate drill rods are housed in an axially extending tubular section (51) to separate the bearings from the spoil through the vacuum section. The axially extending tubular section drill string housing is located fully within the vacuum chamber, surrounded by the vacuum channel and vacuum cavities. It is this full surround by vacuum that functions to absorb heat created by the rotating drill string, transferring it directly to the slurry and spoil cuttings and fluid returning from the drill head, and in turn to the vacuum waste tank.

The laser beam used for drill head guidance travels through the protected top air channel (52). It is the effective removal of heat and creation of a stable laser environment that minimises otherwise unavoidable hot-cold transitions at every drill rod connection. In past drill rods, these hot-cold transitions cause consecutive and culminating laser refraction, leading to an inaccurate borehole.

During connection the drill rods (23, 23) are pushed together. The vacuum thrust adaptor has two conical combination pins (48) in the male drill rod end plate (47) about the rod's longitudinal axis and centred vertically about the drive, and offset equidistant about the horizontal plane. These combination pins have a conical taper at the front and align with two bores (49) in the female drill rod end plate (46) about the rod's longitudinal axis. As the pins are further inserted, the drill rod is aligned to a horizontal plane; the drill rod and connected hexagonal intermediate drill rods are aligned and further inserted until the two end plate faces are mating.

Consecutively during this alignment process, the toggles mounted to the female end plate are caused to pivot about the pivot bush axis, moving radially outwards from the end plate diameter, allowing the major diameter of the combination pins past the toggles. Once the Combination Pins pass the major diameter, the toggles are allowed to spring back to their original position, moving in between the combination pins and the female end plate, thus locking the connection, and allowing either thrust or pullback under load. Once the drill rod end plates are mated face to face, the vacuum and laser space are sealed due to the elastomeric seals inserted in the milled grooves of the female plate.

Referring to FIGS. 2, 4, and 5 the M1 bearing module comprises of a circular disc with a central stepped bore for the location of the front fluid bearing bush. The housing is cross-drilled to divert an axial pressure fluid port originating to the side of the drill rod, connected to a radially drilled port which in turn connects to a radial groove on the inside of the central bore. Two additional smaller radial grooves—one to the rear and one to the front of the channel groove provide housing for o-ring seals which completes this cavity and directs all pressure fluid through to the radial holes drilled through the fluid bush. The radial pressure cavity also connects to a vertical radial port fitted with a jetted plug, which directs some fluid to the Annulus between the steering ring and steering shell M6. At the rear of the M1 bearing module is a self-energising u-cup seal retained by a soft metal bush to complete the front seal cavity.

As shown in FIGS. 2, 6, 7A, 7B, 8A and 8B the M2 steering module comprises a circular disc with a central bore through which the drill rod passes. At the top and to the sides are air channels. At the bottom is the vacuum cavity. There are four radial drillings, bores and counter bores equispaced around the circumference of the disc. Four independent oil ports drilled axially from the rear of the housing and countersunk with face sealing enter the lower portion of the radial drilling in each of the four bores. These bores house the steering pistons with high pressure seals. With pressurised hydraulic oil entering any of these cavities, the associated piston is forced radially outward providing force to move the steering shell M6. The piston is retained from ejection from the housing by a stepped gland ring incorporating a piston rod wiper and auxiliary seal which in turn is retained by an internal circlip within the stepped bore.

The M6 steering shell comprises a hollow tubular section with a front end stepped return section reducing in inside diameter then tapered both internally and externally towards the front. This front stepped return is faced up against the front of M1 bearing module, and the main inner bore has full annular clearance around the circumference of the steering ring assembly allowing the shell to move about radially in any direction. As one piston in the M2 steering module is actuated, the M6 steering shell is forced radially and moves with the extending piston. As the opposing side of the M6 steering shell moves in towards the steering ring assembly, the piston radially opposed to that actuated is in turn retracted, allowing for the next steering manoeuvre. The same applies to the other set of pistons acting about an axis at 90 degrees to the first set of pistons. This actuation on 2-cylinder movement axes, either independently or together allows the drill head to alter its shaft and cutter position relative to the bored hole thus providing steering control.

The hydraulically steered drill head has a fast system for changing cutting tooling. Rock capabilities have been enhanced with the design of a rock roller system for the microtunnelling unit.

The drill head has been modified to accommodate the covered drill rod system and designed to allow for the introduction of automated steering. Drill head segmental design allows for strength and durability whilst enhancing the ability to maintain drill head positioning via hydraulic rams holding a position of one circular piece within a second circular ring providing for maximum strength in minimal space.

The drill shaft must rotate freely under high loads, and pressure fluid must be transferred to the drill face. The use of high-pressure fluids out of the drill face allows for enhanced tooling life whilst also giving the ability to flush tacky ground.

The prior art was to retain the shaft within steel bearings, either tapered roller, or ball bearings with needle thrust bearing. This solved the mechanical rotation issue, but brought with it a whole plethora of associated problems to do with sealing bearings from ingress of cutting spoil and water, both ingredients deadly to bearings. Maintenance is increased as seals and bearings have to be replaced regularly. If a bearing was to seize, it would halt the complete drilling process, drill head would have to be removed for overhaul, causing unplanned down-time and site delays.

The prior art for pressure fluid transmission is with a pressure swivel assembly, which rotates about the shaft axis. The swivel construction would be tubular in design with two pressure seals axially opposed to retain a central pressure chamber within the swivel. A threaded inlet port enters this central pressure chamber radially, flows around the axis of the cavity, through a radial hole drilled in the drill shaft, then through an axial hole in the drill shaft to the front face. This design required external retention of the swivel housing to stop it rotating with the drill shaft, causing radial side-loads on one inside face, in turn, causing seal failure and therefore leakage. The seals had to have a high preload to accommodate high pressure, and would wear grooves in the drill shaft, causing leakage. The swivel would be located behind the target position, so any water spray from leaks would upset visual sight of target. Using pipe fittings from the swivel housing with elbows to bring hose in axially beside drill shaft meant size was too large to be used in small diameter drill heads, assembly and maintenance of hose and fittings would be awkward at best.

The invention entails construction of a modular designed drill head, with integrated pressure fluid conveyance cavities. Further, the invention includes the use of a fluid bearing bush to act as a front drill rod bearing and pressure swivel in one assembly. The fluid bearing bush is retained in the M1 bearing module by three grub screws (equispaced at 120 degrees). Pressure fluid directed to the distribution groove in the M1 bearing module is sealed form escaping past the inside of the stepped bush bore and the outside diameter of the fluid bearing bush by means of two O-ring seals on each side of the distribution groove. This M1 bearing module distribution groove is longitudinally aligned with radial drill holes (eg 6×5 mm diameter holes equispaced at 60 degrees) around the perimeter of the fluid bearing bush. These drill holes enter the inside diameter of the bush and are interconnected with an internal radial distribution groove within the fluid bearing bush. Fluid cannot escape to the rear of the fluid bush due to an energising U-cup seal placed at the rear of M1 bearing module.

The fluid bearing bush encapsulates a mid-front section of the drill rod and provides a centralized bearing location capable of high radial and thrust forces combined. The peened radial holes of the drill rod are longitudinally aligned with the internal radial pressure fluid distribution groove of the fluid bearing bush.

Pressure fluid is proportionally distributed—through radial holes in the drill shaft, connecting to an axial port through to the front cutting rotor, creating back pressure to distribute to the annulus area between the outside diameter of the drill rod and the inside diameter of the fluid bush. This is achieved by high helix angle, low depth multi-start grooves machined on the inside of the fluid bush from the front edge of the distribution groove to the front face of the fluid bush (eg triple-start, 20 mm pitch 0.5 mm deep grooves with 1.5 mm concave radius).

This pressure fluid is then channeled to a helical spiral groove on the front face of the bush (eg single 10 mm pitch continuously decreasing right-hand 0.5 mm deep face groove with 1.5 mm concave radius). This channeling effect essentially hydrostatically separates the shaft from the bush both radially and axially, to counteract steering and thrust face forces. The relationship is linearly proportional in that the higher the load, the harder the faces act against one another, providing a greater hydrostatic seal, which in turn acts to repel the two components.

Hence we have a bearing, which mechanically transfers loads, provides a pressure fluid swivel, and continually lubricates and cools itself. This method allows a very strong shaft construction with minimal stress riser points, excellent radial and axial bearing loads, excellent impact resistance, excellent pressure fluid conveyance, minimal assembly and maintenance costs, and is field replaceable.

The position of the target at the extreme front of the drill head ultimately enhances the drills ability to be extremely accurate and responsive to positional changes. The use of high-pressure fluids out of the drill face allows for enhanced tooling life whilst also giving the ability to flush tacky ground. The ability to run drill fluids at the cutting face creates greater efficiencies within cutting and assists our abilities through varied ground conditions. Front bearing combination of high load axial and thrust bearing with a high-pressure fluid and integrated lubrication system.

The drill rods are inserted and connected consecutively with the thrust module to allow bore hole progression while maintaining drill string, vacuum, air channel, hydraulic, pressure and data line connection. The drill rod transmits torque from the rotation unit mounted on the thrust module to the drill head at the bore face via a drill rod and connected intermediate drill rods. The drill rod also transmits thrust from the rotation unit mounted on the thrust module to the drill head at the bore face via a vacuum tube.

The prior art was to have the vacuum tube section aligned longitudinally with the drill string, situated below it, generally to rest on the invert of the borehole. This allows cutting spoil extraction by vacuum.

The vacuum tube has bearing bushes mounted at each end along the drill rod and connected intermediate drill rods axis to retain the drill rod and connected intermediate drill rods, and male and female cleats at each end for connection by means of a manual pin inserted to two holes either vertically or horizontally aligned. The drill string is exposed, causing possible operator injury from the rotating shaft. The connection method with manual pin insertion is tedious, and pin extraction after bore completion is difficult.

The manual connection method required clearance to allow manual connection. This clearance between subsequent drill rods allows each rod to rotate slightly about its axis as a result of drill string rotational torque. This rotation, possibly only 1 degree per rod, extrapolates the error the further the borehole. Final error over a 100 m bore could be a 50-degree rotation, causing an inaccurate target position relative to the start point. This target position is then potentially out by up to 10 mm.

The borehole is not peripherally supported, causing ground collapse in certain ground conditions, thereby blocking laser and target view, and halting drilling operation. The bearings are directly under the laser position, causing hot sections at each end of the drill rod and a cooler section between the bearings. These hot-cold transitions cause consecutive and culminating laser refraction, leading to an inaccurate borehole.

The microtunnelling system uses a casing mounted on the drill rod that includes at least two axially extending cavities or bores wherein liquid is axially transported along one of said axially extending cavities or bores under pressure to the drill head to assist drilling and resulting slurry is vacuum returned along the other of said axially extending cavities or bores. However as drill rods are fully enclosed, and slightly smaller than the drill head diameter allowing the microtunnelling machine to be effective in collapsing ground conditions, under water table, soft or hard ground. The vacuum or slurry spoil extraction volume within the drill rod provides minimum restriction to increase productivity and length of lines achievable. With all moving components enclosed, the drill rod is safer to use.

Rotation within vacuum or slurry spoil eliminates heat from bearings, minimising laser distortion and wear and tear to the equipment. Enclosed laser space for stability of beam. Provides airflow to equalize temperature and humidity, more accurate operation. Automatic alignment system speeds and simplifies operation. Automatic clamping system, for positive joining, withstands full load in both forward and reverse directions. Clamping system maintains strong sealing of vacuum. Fully encapsulated hose and dataline pocket, protecting sensitive data and pressure lines.

The pullback extraction reamer is used to increase the size of a microtunnelled bore hole. This is advantageous for operators as one size microtunnelling drill head and drill rods can be used in conjunction with a pullback extraction reamer in various bore sizes, while maintaining good productivity. Once the drill head reaches the reception shaft, the drill head is removed from the end of the drill rod and replaced by the pullback extraction reamer. The product pipe to be installed can be coupled to the pipe pullback adaptor mounted on the rear. Drilling is now commenced in reverse, or pullback mode. The drill string is coupled to a drive spur gear that rotates three planetary gears fixedly mounted to the vacuum thrust plate. The spur gears are meshed inside an internal ring gear that is fixed to the cutter hub, allowing the cutter hub to rotate at a lower speed but higher torque than its input drive. The cutter hub is mounted to the pipe pullback adaptor by way of thrust and radial bearings. This embodiment allows the drill rod and pullback pipe to remain rotatably fixed and the reamer cutter hub can rotate about the longitudinal axis at a greater torque. The cutter hub is typically concave within its cutting face, so that as it is pulled back through the ground, slurry and spoil are offered to the vacuum or slurry channel entrance for evacuation.

It should be understood that the above description is of a preferred embodiment and included as illustration only. It is not limiting of the invention. Clearly a person skilled in the art without any inventiveness would understand variations of the microtunnelling system and apparatus and such variations are included within the scope of this invention as defined in the following claims.

The invention claimed is:

1. A cutting apparatus for a drill head section, the cutting apparatus comprising:

a front cutting rotor having a central hub defining a central cavity that extends completely through the central hub and is adapted to receive a drill shaft, the central cavity having flats adapted to engage corresponding flats of the drill shaft to allow torque to be transferred from the drill shaft to the front cutting rotor, the front cutting rotor also including a plurality of cutting bars having lengths, widths and depths, the depths extending in a front to back orientation along an axis of rotation of the front cutting rotor and the lengths projecting radially outwardly from the central hub, the lengths being longer than the depths, the lengths being longer than the widths, the widths being oriented perpendicular relative to the lengths and the depths, and the cutting bars including surfaces at which a plurality of cutting teeth are mounted; and a front retainer that mounts at a front side of the front cutting rotor for retaining the front cutting rotor on the drill shaft, the front retainer including a front cutting surface and also including a rear internally threaded opening into which a threaded end portion of the drill shaft is threaded.

2. The cutting apparatus of claim 1, wherein the front retainer is conical.

3. The cutting apparatus of claim 1, wherein a plurality of cutting teeth are mounted on the front cutting surface of the front retainer.

4. The cutting apparatus of claim 1, wherein the cutting bars of the front cutting rotor have outermost ends, and wherein at least some of the cutting teeth provided on the front cutting rotor have outer cutting tips that extend radially outwardly beyond the outermost ends of the cutting bars.

5. The cutting apparatus of claim 1, wherein the cutting bars define ports for delivering liquid to a cutting face of the cutting apparatus to facilitate cutting operations.

6. The cutting apparatus of claim 1, wherein the front retainer defines ports for delivering liquid to a cutting face of the cutting apparatus to facilitate cutting operations.

7. The cutting apparatus of claim 1, wherein the cutting bars and the front retainer define ports for delivering liquid to a cutting face of the cutting apparatus to facilitate cutting operations.

8. The cutting apparatus of claim 4, wherein the cutting bars include front sides and back sides, wherein the outermost ends of the cutting bars include relief surfaces that face at least partially radially outwardly with respect to a central axis of rotation of the drill shaft, the relief surfaces extending at least partially in a front to back direction and angling inwardly toward the central axis of rotation as the relief surfaces extend at least partially in the front to back direction.

9. The cutting apparatus of claim 1 wherein the drill shaft defines an axis of rotation that extends through a length of the drill shaft, wherein the drill shaft and the front cutting rotor are rotatable together about the axis of rotation, wherein the drill shaft defines a first fluid passage that extends through the drill shaft along the length of the drill shaft, wherein the cutting bars define second fluid passages in fluid communication with the first fluid passage, wherein the second fluid passages extend radially outwardly from the axis of rotation along the lengths of the cutting bars, wherein the cutting bars define drilling fluid discharge ports in fluid communication with the second passages for discharging drilling fluid, and wherein the drilling fluid is directed through the first and second fluid passages and is discharged from the cutting apparatus through the drilling fluid discharge ports.

10. A cutting apparatus adapted to be rotated by a drill shaft defining a central axis of rotation that extends along a length of the drill shaft, the cutting apparatus comprising:

a front cutting rotor having a hub defining a shaft receiver that extends at least partially through the hub in a direction extending from a back side toward a front cutting side of the front cutting rotor, the shaft receiver being configured to receive the drill shaft, the drill shaft and the shaft receiver cooperating to define a torque transmitting mechanical interface for allowing torque to be transferred between the drill shaft and the front cutting rotor such that the drill shaft can be used to rotate the front cutting rotor about the central axis of rotation, the front cutting rotor also including a plurality of cutting bars having lengths, widths and depths, the depths extending in a front to back along an axis of rotation of the front cutting rotor and the lengths projecting at least partially radially outwardly from the hub, the widths being oriented perpendicular relative to the lengths and the depths, the lengths being longer than the depths and the lengths being longer than the widths; and a front retainer that mounts at the front cutting side of the front cutting rotor for retaining the front cutting rotor on the drill shaft, the front retainer including a front cutting side, the front retainer being connected to the drill shaft by a threaded connection, wherein the front cutting rotor can be removed from the drill shaft when the front retainer is unthreaded from the drill shaft.

11. The cutting apparatus of claim 10, wherein a plurality of cutting teeth are mounted at the front cutting side of the front retainer.

12. The cutting apparatus of claim 10, wherein a plurality of cutting teeth are mounted at the front cutting side of the front cutting rotor.

13. The cutting apparatus of claim 10, wherein a plurality of cutting teeth are mounted at the front cutting side of the front cutting rotor and at the front cutting side of the front retainer.

14. The cutting apparatus of claim 10, wherein the cutting bars of the front cutting rotor have outermost ends, wherein cutting teeth are provided on the front cutting rotor, and wherein at least some of the cutting teeth provided on the front cutting rotor have outer cutting tips that extend radially outwardly beyond the outermost ends of the cutting bars.

15. The cutting apparatus of claim 10, wherein the cutting bars include outermost ends, wherein the outermost ends of the cutting bars include relief surfaces that face at least partially radially outwardly with respect to the central axis of rotation of the drill shaft, the relief surfaces extending at least partially in a front to back direction and angling inwardly toward the central axis of rotation as the relief surfaces extend at least partially in the front to back direction.

16. A cutting apparatus adapted to be rotated by a drill shaft defining a central axis of rotation that extends along a length of the drill shaft, the drill shaft also defining a first fluid passage that extends along the length of the drill shaft, the cutting apparatus comprising:

a front cutting rotor having a hub defining a shaft receiver that extends at least partially through the hub in a direction extending from a back side toward a front cutting side of the front cutting rotor, the shaft receiver being configured to receive the drill shaft, the drill shaft and the shaft receiver cooperating to define a torque transmitting mechanical interface for allowing torque to be transferred between the drill shaft and the front cutting rotor such that the drill shaft can be used to rotate the front cutting rotor about the central axis of rotation, the front cutting rotor also including a plurality of cutting bars having lengths, widths and depths, the depths extending in a front to back orientation along an axis of rotation of the front cutting rotor and the lengths projecting primarily radially outwardly from the hub, at least a first of the cutting bars defining a second fluid passage that extends along the length of the first cutting bar, the second fluid passage being in fluid communication with the first fluid passage when the front cutting rotor is mounted on the drill shaft, the first cutting bar also defining fluid discharge ports in fluid communication with the second fluid passage, the fluid discharge ports being spaced-apart from one another along the length of the first cutting bar, the widths being oriented perpendicular relative to the lengths and the depths, the lengths of the cutting bars being longer than the depths of the cutting bars, and the lengths of the cutting bars being longer than the widths of the cutting bars; and a front retainer that mounts at the front cutting side of the front cutting rotor and connects to the drill shaft for retaining the front cutting rotor on the drill shaft, the front retainer including a front cutting side, wherein the front cutting rotor can be removed from the drill shaft when the front retainer is disconnected from the drill shaft.

17. The cutting apparatus of claim 16, wherein the fluid discharge ports include forwardly facing ports and rearwardly facing ports.

18. The cutting apparatus of claim 16, wherein a fluid connection is made between the first fluid passage and the second fluid passage within the shaft receiver.

19. The cutting apparatus of claim 16, wherein a plurality of cutting teeth are mounted at the front cutting side of the front retainer.

20. The cutting apparatus of claim 16, wherein a plurality of cutting teeth are mounted at the front cutting side of the front cutting rotor.

21. A cutting apparatus for a drilling device, the cutting apparatus comprising:

a cutting rotor having a hub defining an opening that extends completely through the cutting rotor in a direction extending from a back side toward a front cutting side of the cutting rotor, the opening defining a shaft receiver that extends at least partially through the hub in a direction extending from a back side toward a front cutting side of the cutting rotor, the shaft receiver including a plurality of flats that provide a torque transmission interface, the cutting rotor also including a plurality of cutting bars having lengths, widths and depths, the depths extending in a front to back orientation along an axis of rotation of the cutting rotor and the lengths projecting at least partially radially outwardly from the hub, at least a first of the cutting bars defining a fluid passage that extends along the length of the first cutting bar, the fluid passage being in fluid communication with the opening defined by the hub of the cutting rotor, the cutting bar also defining fluid discharge ports in fluid communication with the fluid passage, the fluid discharge ports being spaced-apart from one another along the length of the first cutting bar, the widths being oriented perpendicular relative to the lengths and the depths, the lengths of the cutting bars being longer than the depths of the cutting bars, and the lengths of the cutting bars being longer than the widths of the cutting bars.

22. The cutting apparatus of claim 21, wherein the fluid discharge ports include forwardly facing ports.

23. The cutting apparatus of claim 22, wherein the fluid discharge ports also include rearwardly facing ports.

* * * * *